US012256876B2

(12) United States Patent
Morin et al.

(10) Patent No.: US 12,256,876 B2
(45) Date of Patent: Mar. 25, 2025

(54) EVACUATION STATION

(71) Applicant: iRobot Corporation, Bedford, MA (US)

(72) Inventors: Russell Walter Morin, Burlington, MA (US); Harold Boeschenstein, Marblehead, MA (US); David Orrin Swett, Waltham, MA (US); Jude Royston Jonas, Hudson, NH (US)

(73) Assignee: iRobot Corporation, Bedford, MA (US)

( * ) Notice: Subject to any disclaimer, the term of this patent is extended or adjusted under 35 U.S.C. 154(b) by 465 days.

(21) Appl. No.: 17/822,362

(22) Filed: Aug. 25, 2022

(65) Prior Publication Data

US 2022/0409000 A1 Dec. 29, 2022

Related U.S. Application Data

(60) Continuation of application No. 16/184,450, filed on Nov. 8, 2018, now Pat. No. 11,445,880, which is a (Continued)

(51) Int. Cl.
*A47L 11/40* (2006.01)
*A47L 9/00* (2006.01)

(Continued)

(52) U.S. Cl.
CPC ..... *A47L 11/4025* (2013.01); *A47L 9/149* (2013.01); *A47L 9/19* (2013.01); *A47L 9/2821* (2013.01);

(Continued)

(58) Field of Classification Search
CPC ..... A47L 11/4025; A47L 9/149; A47L 9/19; A47L 9/2821; A47L 9/2842;

(Continued)

(56) References Cited

U.S. PATENT DOCUMENTS 74,044 A 2/1868 Burnham
1,417,468 A 5/1922 Radimk (Continued)

FOREIGN PATENT DOCUMENTS

CN 1121797 5/1996
CN 1211907 9/2000

(Continued)

OTHER PUBLICATIONS

"Deebot D79 Self-emptying Multi-surface Floor Vacuum Robot," Ecovacs Robotics, 2015, Retrieved from the Internet at URL https://ecovacsrobotics.com/ecovacs-robotics-products/deebot-floor-cleaning-robots/d7-series/d79/, 10 pages.

(Continued)

*Primary Examiner* — David Redding

(74) *Attorney, Agent, or Firm* — Fish & Richardson P.C.

(57) ABSTRACT

A mobile robot includes a body configured to traverse a surface and to receive debris from the surface, and a debris bin within the body. The debris bin includes a chamber to hold the debris received by the mobile robot, an exhaust port through which the debris exits the debris bin; and a door unit over the exhaust port. The door unit includes a flap configured to move, in response to air pressure at the exhaust port, between a closed position to cover the exhaust port and an open position to open a path between the chamber and the exhaust port. The door unit, including the flap in the open position and in the closed position, is within an exterior surface of the mobile robot.

20 Claims, 15 Drawing Sheets

Related U.S. Application Data continuation of application No. 15/901,380, filed on Feb. 21, 2018, now Pat. No. 10,154,768, which is a continuation of application No. 15/259,732, filed on Sep. 8, 2016, now Pat. No. 9,924,846, which is a division of application No. 14/750,563, filed on Jun. 25, 2015, now Pat. No. 9,462,920.

(51) Int. Cl.
*A47L 9/14* (2006.01)
*A47L 9/19* (2006.01)
*A47L 9/28* (2006.01)

(52) U.S. Cl.
CPC ..... *A47L 9/2842* (2013.01); *A47L 11/4011* (2013.01); *A47L 9/0081* (2013.01); *A47L 9/2889* (2013.01); *A47L 2201/022* (2013.01); *A47L 2201/024* (2013.01); *A47L 2201/04* (2013.01)

(58) Field of Classification Search
CPC .. A47L 11/4011; A47L 9/0081; A47L 9/2889; A47L 2201/022; A47L 2201/024; A47L 2201/04; A47L 2201/00
See application file for complete search history.

(56) References Cited

U.S. PATENT DOCUMENTS

| | | | |
|---|---|---|---|
| 2,770,825 | A | 11/1956 | Pullen |
| 2,868,321 | A | 1/1959 | Kelley |
| 2,892,511 | A | 6/1959 | Gall et al. |
| 3,863,285 | A | 2/1975 | Hiroshi |
| 4,118,208 | A | 10/1978 | Klinedinst |
| 5,092,915 | A | 3/1992 | Lackner |
| 5,345,649 | A | 9/1994 | Whitlow |
| 5,740,581 | A | 4/1998 | Harrelson, II |
| 5,787,545 | A | 8/1998 | Colens |
| 5,959,423 | A | 9/1999 | Nakanishi et al. |
| 5,995,884 | A | 11/1999 | Allen et al. |
| 6,033,451 | A | 3/2000 | Fish et al. |
| 6,076,226 | A | 6/2000 | Reed |
| 6,094,775 | A | 8/2000 | Behmer |
| 6,272,712 | B1 | 8/2001 | Gockel et al. |
| 6,281,659 | B1 | 8/2001 | Giuseppe |
| 6,389,329 | B1 | 5/2002 | Colens |
| 6,594,844 | B2 | 7/2003 | Jones |
| 6,615,446 | B2 | 9/2003 | Noreen et al. |
| 6,690,134 | B1 | 2/2004 | Jones et al. |
| 6,712,868 | B2 | 3/2004 | Murphy et al. |
| 6,809,490 | B2 | 10/2004 | Jones et al. |
| 6,883,201 | B2 | 4/2005 | Jones et al. |
| D510,066 | S | 9/2005 | Hickey et al. |
| 6,956,348 | B2 | 10/2005 | Landry et al. |
| 7,024,278 | B2 | 4/2006 | Chiappetta et al. |
| 7,024,724 | B2 | 4/2006 | Ponjican et al. |
| 7,031,805 | B2 | 4/2006 | Lee et al. |
| 7,055,210 | B2 | 6/2006 | Keppler et al. |
| 7,155,308 | B2 | 12/2006 | Jones |
| 7,188,000 | B2 | 3/2007 | Chiappetta et al. |
| 7,196,487 | B2 | 3/2007 | Jones et al. |
| 7,201,786 | B2 | 4/2007 | Wegelin et al. |
| 7,203,991 | B2 | 4/2007 | Stephens et al. |
| 7,225,500 | B2 | 6/2007 | Diehl et al. |
| 7,332,890 | B2 | 2/2008 | Cohen et al. |
| 7,346,428 | B1 | 3/2008 | Huffman et al. |
| 7,412,748 | B2 | 8/2008 | Lee et al. |
| 7,513,007 | B2 | 4/2009 | Chernoff |
| 7,706,917 | B1 | 4/2010 | Chiappetta et al. |
| 7,729,801 | B2 | 6/2010 | Abramson |
| 7,779,504 | B2 | 8/2010 | Lee et al. |
| 7,849,555 | B2 | 12/2010 | Hahm et al. |
| 8,087,117 | B2 | 1/2012 | Kapoor et al. |
| 8,092,562 | B2 | 1/2012 | Sauer et al. |
| 8,386,081 | B2 | 2/2013 | Landry et al. |
| 8,428,776 | B2 | 4/2013 | Letsky |
| 8,528,157 | B2 | 9/2013 | Schnittman et al. |
| 8,572,799 | B2 | 11/2013 | Won et al. |
| 8,706,297 | B2 | 4/2014 | Letsky |
| 8,741,013 | B2 | 6/2014 | Swett et al. |
| 8,756,751 | B2 | 6/2014 | Jung et al. |
| 8,972,052 | B2 | 3/2015 | Chiappetta |
| 8,984,708 | B2 | 3/2015 | Kuhe et al. |
| 9,008,835 | B2 | 4/2015 | Dubrovsky et al. |
| 9,462,920 | B1 | 10/2016 | Morin et al. |
| 9,788,698 | B2 | 10/2017 | Morin et al. |
| 9,924,846 | B2 | 3/2018 | Morin et al. |
| 9,931,007 | B2 | 4/2018 | Morin et al. |
| 10,154,768 | B2 | 12/2018 | Morin et al. |
| 11,445,880 | B2 | 9/2022 | Morin et al. |
| 2002/0124343 | A1 | 9/2002 | Reed |
| 2004/0163205 | A1 | 8/2004 | Albert et al. |
| 2004/0255425 | A1 | 12/2004 | Arai et al. |
| 2005/0015920 | A1 | 1/2005 | Kim et al. |
| 2005/0132680 | A1 | 6/2005 | Wegelin et al. |
| 2005/0150519 | A1 | 7/2005 | Keppler et al. |
| 2005/0156562 | A1 | 7/2005 | Cohen et al. |
| 2005/0183229 | A1 | 8/2005 | Uehigashi |
| 2006/0037170 | A1 | 2/2006 | Shimizu |
| 2007/0157415 | A1 | 7/2007 | Lee et al. |
| 2007/0157420 | A1 | 7/2007 | Lee et al. |
| 2007/0226949 | A1 | 10/2007 | Hahm et al. |
| 2007/0245511 | A1 | 10/2007 | Hahm et al. |
| 2008/0047092 | A1 | 2/2008 | Schnittman et al. |
| 2008/0052846 | A1 | 3/2008 | Kapoor et al. |
| 2008/0161969 | A1 | 7/2008 | Lee et al. |
| 2008/0201895 | A1 | 8/2008 | Kim et al. |
| 2008/0235897 | A1 | 10/2008 | Kim et al. |
| 2009/0044370 | A1 | 2/2009 | Won et al. |
| 2009/0049640 | A1 | 2/2009 | Lee et al. |
| 2010/0011529 | A1 | 1/2010 | Won et al. |
| 2010/0107355 | A1 | 5/2010 | Won et al. |
| 2010/0263142 | A1 | 10/2010 | Jones et al. |
| 2012/0011676 | A1 | 1/2012 | Jung et al. |
| 2012/0011677 | A1 | 1/2012 | Jung |
| 2012/0084937 | A1 | 4/2012 | Won et al. |
| 2012/0102670 | A1 | 5/2012 | Jang et al. |
| 2012/0167917 | A1 | 7/2012 | Gilbert |
| 2012/0199006 | A1 | 8/2012 | Swett et al. |
| 2012/0291809 | A1 | 11/2012 | Kuhe et al. |
| 2013/0298350 | A1 | 11/2013 | Schnittman |
| 2014/0100693 | A1 | 4/2014 | Fong et al. |
| 2014/0109339 | A1 | 4/2014 | Won et al. |
| 2014/0130272 | A1 | 5/2014 | Won et al. |
| 2014/0207282 | A1 | 7/2014 | Angle et al. |
| 2015/0223651 | A1 | 8/2015 | Kuhe et al. |
| 2016/0374528 | A1 | 12/2016 | Morin et al. |
| 2018/0235424 | A1 | 8/2018 | Morin et al. |
| 2019/0133399 | A1 | 5/2019 | Morin et al. |

FOREIGN PATENT DOCUMENTS

| | | |
|---|---|---|
| CN | 1454566 | 11/2003 |
| CN | 1605399 | 4/2005 |
| CN | 1683120 | 10/2005 |
| CN | 101049218 | 10/2007 |
| CN | 101273860 | 10/2008 |
| CN | 101352326 | 1/2009 |
| CN | 102188215 | 9/2011 |
| CN | 102334943 | 2/2012 |
| CN | 102949145 | 3/2013 |
| CN | 102961085 | 3/2013 |
| CN | 101554313 | 10/2013 |
| CN | 203693481 | 7/2014 |
| DE | 102010000607 | 9/2011 |
| DE | 102012109938 | 4/2014 |
| EP | 0681807 | 11/1995 |
| EP | 0769923 | 5/1997 |
| EP | 1243218 | 9/2002 |
| EP | 2407074 | 1/2012 |
| ES | 2238196 | 8/2005 |
| JP | 63-153115 | 6/1988 |
| JP | H0275058 U | 6/1990 |

(56) References Cited

FOREIGN PATENT DOCUMENTS

| | | |
|---|---|---|
| JP | 2001161619 | 6/2001 |
| JP | 2001212052 | 8/2001 |
| JP | 2001321308 | 11/2001 |
| JP | 2002345706 | 12/2002 |
| JP | 2004283327 | 10/2004 |
| JP | 2005124753 | 5/2005 |
| JP | 2005204909 | 8/2005 |
| JP | 2007512534 | 5/2007 |
| JP | 2007181652 | 7/2007 |
| JP | 2018522613 | 8/2018 |
| KR | 20030016807 | 3/2003 |
| KR | 100657736 | 12/2006 |
| KR | 20070010298 | 1/2007 |
| KR | 20070103248 | 10/2007 |
| KR | 20070112908 | 11/2007 |
| KR | 20100004539 | 1/2010 |
| KR | 20100128839 | 12/2010 |
| KR | 20120046928 | 5/2012 |
| WO | WO 2002084875 | 10/2002 |
| WO | WO 2003024292 | 9/2003 |
| WO | WO 2005055795 | 6/2005 |
| WO | WO 2007088192 | 8/2007 |
| WO | WO 2009042692 | 4/2009 |
| WO | WO 2012123144 | 9/2012 |
| WO | WO 2015082019 | 6/2015 |

OTHER PUBLICATIONS

Deebot D77 Instruction Manual, Ecovacs Robotics, Inc., Copyright 2013, 20 pages.

Deebot D79 Instruction Manual, Ecovacs Robotics, Inc., copyright 2015, 72 pages.

EP Supplementary European Search Report in European Appln. No. 20180061.2, dated Jan. 11, 2021, 5 pages.

Hitachi: News release: "The home cleaning robot of the autonomous movement type (experimental machine)," Retrieved from the Internet: URL<www.i4u.com./japanreleases/hitachirobot.htm>, Mar. 2005, 5 pages.

International Preliminary Report on Patentability in International Application PCT/US2015/061842, dated Dec. 26, 2017, 7 pages.

International Search Report and Written Opinion in International Application No. PCT/US2015/061842, mailed Mar. 11, 2016, 13 pages.

Karcher "Karcher RoboCleaner RC 3000," Retrieved from the Internet: URL<www.robocleaner.de/english/screen3.html>, accessed Dec. 2003, 4 pages.

Karcher USA, RC3000 Robotic Cleaner, website: http://www.karcherusa.com/showproducts.php?op=viewprod&paraml=143&param2=&param3=, accessed Mar. 2005, 3 pages.

Karcher, "Product Manual Download Karch", available at www.karcher.com, 2004, 18 pages.

Maschinemarkt Wurzburg, Robovac1999, 105, No. 27, pp. 3, 30, Jul. 5, 1999 (with English translation).

'Samsung.com' (online]. "SR8900 Robot VC with Auto-Emptying Dust Bin, 40 W," copyright 1995-2015 (retrieved on Dec. 9, 2015]. Retrieved from the Internet at URL http://www.samsung.com/au/consumer/home-appliances/vacuum-cleaners/roboUVCR8980L4K/XSA, 7 pages.

Supplementary European Search Report in European Application No. 15896588.9, dated Jan. 22, 2019, 7 pages.

Taniguchi, "Lobo cleaner TORNEO ROBO earning garbage on the charging base from Toshiba, cleaning up to the corner with a long brush," Aug. 21, 2014, retrieved from the Internet at URL<http://japanese.engadget.com/2014/08/21/torneo-robo/>, 12 pages, English translation included.

EVACUATION STATION

CROSS-REFERENCE TO RELATED APPLICATIONS

This application is a continuation application of and claims priority to U.S. application Ser. No. 16/184,450, filed Nov. 8, 2018, now U.S. Pat. No. 11,445,880 which is a continuation application of and claims priority to U.S. application Ser. No. 15/901,380, now U.S. Pat. No. 10,154,768, filed Feb. 21, 2018, which is a continuation of and claims priority to U.S. application Ser. No. 15/259,732, now U.S. Pat. No. 9,924,846, filed Sep. 8, 2016, which is a divisional application of and claims priority to U.S. application Ser. No. 14/750,563, now U.S. Pat. No. 9,462,920, filed on Jun. 25, 2015. The entire contents of each are hereby incorporated by reference.

TECHNICAL FIELD

This specification relates generally to evacuating debris collected by a mobile robot.

BACKGROUND

Cleaning robots include mobile robots that perform desired cleaning tasks, such as vacuuming, in unstructured environments. Many kinds of cleaning robots are autonomous to some degree and in different ways. For example, an autonomous cleaning robot may be designed to automatically dock with an evacuation station for the purpose of emptying its cleaning bin of vacuumed debris.

SUMMARY

In some examples, a mobile robot includes a body configured to traverse a surface and to receive debris from the surface, and a debris bin within the body. The debris bin includes a chamber to hold the debris received by the mobile robot, an exhaust port through which the debris exits the debris bin; and a door unit over the exhaust port. The door unit includes a flap configured to move, in response to air pressure at the exhaust port, between a closed position to cover the exhaust port and an open position to open a path between the chamber and the exhaust port. The door unit, including the flap in the open position and in the closed position, is within an exterior surface of the mobile robot.

In some examples, the door unit can include a semi-spherical support structure within the debris bin. The flap can be mounted on, and concavely curved relative to, the semi-spherical support structure.

The exhaust port and the door unit can be adjacent to a corner of the debris bin and can be positioned so that the flap faces outwardly towards the debris bin relative to the corner.

The flap can be connected to the semi-spherical support structure by one or more hinges. The door unit can further include a stretchable material adhered, by an adhesive, to both the flap and the semi-spherical support structure. The stretchable material can cover the one or more hinges and an intersection of the flap and the semi-spherical support structure. The adhesive can be absent at a location of the one or more hinges and at the intersection of the flap and the semi-spherical support structure.

The flap can be connected to the semi-spherical support structure by a biasing mechanism. In some examples, the biasing mechanism can include a torsion spring. The torsion spring can be connected to both the flap and the semi-spherical support structure. The torsion spring can have a nonlinear response to the air pressure at the exhaust port. The torsion spring can require a first air pressure to move and thereby place the flap in an open position and a second air pressure to maintain the flap in the open position. The first air pressure can be greater than the second air pressure.

In some examples, the biasing mechanism can include a relaxing spring that can require a first air pressure to move and thereby place the flap in an open position and a second air pressure to maintain the flap in the open position. The first air pressure can be greater than the second air pressure.

In some examples, the mobile robot can be a vacuum cleaner including a suction mechanism. The surface can be a floor. The mobile robot can further include a controller to control operation of the mobile robot to traverse the floor. The controller can control the suction mechanism for suctioning debris from the floor into the debris bin during traversal of the floor.

In some examples, an evacuation station includes a control system including one or more processing devices programmed to control evacuation of a debris bin of a mobile robot. The evacuation station includes a base to receive the mobile robot. The base includes an intake port to align to an exhaust port of the debris bin. The evacuation station further includes a canister to hold a bag to store debris from the debris bin and one or more conduits extending from the intake port to the bag through which debris is transported between the intake port and the bag. The evacuation station also includes a motor that is responsive to commands from the control system to remove air from the canister and thereby generate negative air pressure in the canister to evacuate the debris bin by suctioning the debris from the debris bin, and a pressure sensor to monitor the air pressure. The control system is programmed to control an amount of time to evacuate the debris bin based on the air pressure monitored by the pressure sensor.

In some examples, to control the amount of time to evacuate the debris bin based on the air pressure, the control system can be programmed to detect a steady state air pressure following a start of evacuation. The control system can be programmed to continue to apply the negative pressure for a predefined period of time during which the steady state air pressure is maintained and to send a command to stop operation of the motor.

The base can include electrical contacts that can mate to corresponding electrical contacts on the mobile robot to enable communication between the control system and the mobile robot. The control system can be programmed to receive a command from the mobile robot to initiate evacuation of the debris bin.

In some examples, the pressure sensor can include a Micro-Electro-Mechanical System (MEMS) pressure sensor.

In some examples, the intake port can include a rim that defines a perimeter of the intake port. The rim can have a height that is less than a clearance of an underside of the mobile robot, thereby allowing the mobile robot to pass over the rim. The intake port can include a seal inside of the rim. The seal can include a deformable material that is movable relative to the rim in response to the air pressure. In some examples, in response to the air pressure, the seal can be movable to contact, and conform to, a shape of the exhaust port of the debris bin. The seal can include one or more slits therein. In some examples, the seal can have a height that is less than a height of the rim and, absent the air pressure, is below an upper surface of the rim.

In some examples, the one or more conduits can include a removable conduit extending at least partly along a bottom of the base between the intake port and the canister. The removable conduit can have a cross-sectional shape that transitions from at least partly rectangular adjacent to the intake port to at least partly curved adjacent to the canister. The cross-sectional shape of the removable conduit can be at least partly circular adjacent to the canister.

In some examples, the evacuation station can further include foam insulation within the canister. The motor can be arranged to draw air from the canister along split paths adjacent to the foam insulation leading to an exit port on the canister.

In some examples, the base can include a ramp that increases in height relative to a surface on which the evacuation station rests. The ramp can include one or more robot stabilization protrusions between a surface of the ramp and an underside of the mobile robot.

In some examples, the canister can include a top that is movable between an open position and a closed position. The top can include a plunger that is actuated as the top is closed. The one or more conduits can include a first pipe and a second pipe within the canister. The first pipe can be stationary, and the second pipe can be movable into contact with the bag in response to movement of the plunger, thereby creating a path for debris to pass between the debris bin and the bag. The second pipe, when in contact with the bag, can make a substantially airtight seal to a latex membrane of the bag. The first pipe and the second pipe can be interfaced via flexible grommets. A cam mechanism can control movement of the second pipe based on movement of the plunger. The second pipe can be movable out of contact with the bag in response to moving the top into the open position.

In some examples, the control system can be programmed to control the amount of time to evacuate the debris bin based on the air pressure exceeding a threshold pressure of the canister. The threshold pressure can indicate that the bag has become full of the debris.

Advantages of the foregoing may include, but are not limited to, the following. The flap (also referred to as the door), by remaining enclosed within the exterior surface of the robot, will not contact objects in the environment when the flap (door) is in the open position. As a result, in some examples, if the flap is opened when the robot navigates along a floor surface, the flap does not contact the floor surface. The flap can be made of a flexible or compliant material or can be made of a rigid material such as a plastic.

The deformable material can last through several evacuation operations before being replaced. By being below the rim, the deformable material does not contact the mobile robot while the mobile robot is docking at the evacuation station and thus does not experience friction and contact forces that can damage the deformable material. Because the material is deformable, the material can improve air flow by creating an air-tight seal between the exhaust port of the debris bin and the intake port of the evacuation station. The seal can prevent air from leaking between the exhaust port and the intake port and can thus improve the efficiency of the negative air pressure used during the evacuation operation.

The removable conduit allows the user to easily clean debris stuck or entrained within the removable conduit. The cross-sectional shapes of the removable conduit allow the removable conduit to transport air (and, hence, the debris) without causing significant turbulence. The cross-sectional shapes of the removable conduit, by transitioning from a rectangular shape to a curved shape, further allow the base of the evacuation station to be angled to include a ramp having increasing height, which improves efficiency of evacuating debris from the debris bin.

The movable conduit allows the user to place a bag into the evacuation station without requiring the user to directly manipulate the bag to allow flow of air and debris to pass through the movable pipe into the bag. Rather, the user can simply place the bag in a canister of the evacuation station and close the top. The bag thus requires less user manipulation to operate with the evacuation station.

The controller can adaptively control the time in which it performs the evacuation operation (e.g., operates a motor of the evacuation station). The time of the evacuation operation can thus be minimized to improve power efficiency of the evacuation station and to reduce the time that the evacuation operation generates noise in the environment (caused by, for example, the motor of the evacuation station).

Any two or more of the features described in this specification, including in this summary section, can be combined to form implementations not specifically described herein.

The robots, or operational aspects thereof, described herein can be implemented as/controlled by a computer program product that includes instructions that are stored on one or more non-transitory machine-readable storage media, and that are executable on one or more processing devices to control (e.g., to coordinate) the operations described herein. The robots, or operational aspects thereof, described herein can be implemented as part of a system or method that can include one or more processing devices and memory to store executable instructions to implement various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

Figure 1:
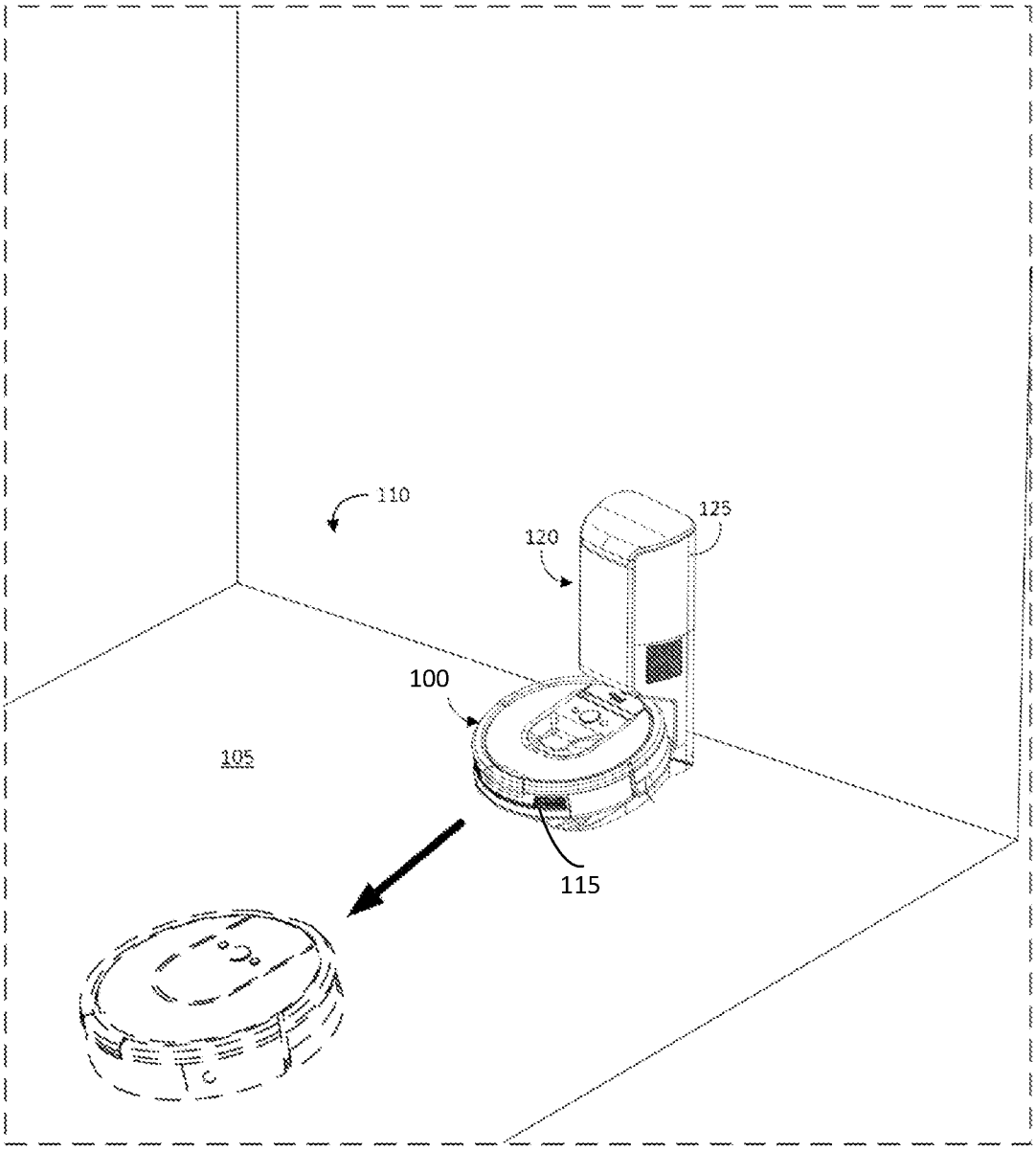
FIG. 1 is a perspective view of a mobile robot navigating in an environment with an evacuation station.

Described herein are example robots configured to traverse (or to navigate) surfaces, such as floors, carpets, or other materials, and to perform various cleaning operations including, but not limited to, vacuuming. Also described herein are examples of evacuation stations, at which the mobile robots can dock to evacuate debris stored in debris bins on the mobile robots. Referring to the example of FIG. 1, a mobile robot 100 is configured to execute a cleaning operation to ingest debris as the mobile robot navigates about a surface 105 of an environment 110. The ingested debris is stored in a debris bin 115 on the mobile robot 100. The debris bin 115 becomes full after the mobile robot 100 has ingested a certain amount of debris.

After the debris bin has become full, the mobile robot can navigate to and dock at an evacuation station 120. Generally, an evacuation station can additionally serve as, for example, a charging station and a docking station. The evacuation station includes a base station configured to remove debris from the debris bin, and to perform other functions vis-à-vis the mobile robot, such as charging. The evacuation station includes a control system, which can include one or more processing devices that are programmed to control operation of the evacuation station. In this example, the evacuation station 120 is controlled to generate negative air pressure to suction ingested debris out of the debris bin 115 and into the evacuation station 120. As part of the evacuation operation, the debris is directed into a removable bag (not shown in FIG. 1) housed in a canister 125 in the evacuation station 120. Between the debris bin 115 and the bag, the evacuation station 120 includes conduits (not shown in FIG. 1) that allow debris to pass from the debris bin 115 and into the bag. As described herein, the conduits can include a removable conduit that can be removed and cleaned, and a movable conduit that is controllable to move into, and out of, contact with the bag. Following evacuation, the mobile robot 100 can undock from the evacuation station 120, and execute a new cleaning (or other) operation. The evacuation station 120 also includes one or more ports, to which the mobile robot 100 interfaces for charging.

Figure 2:
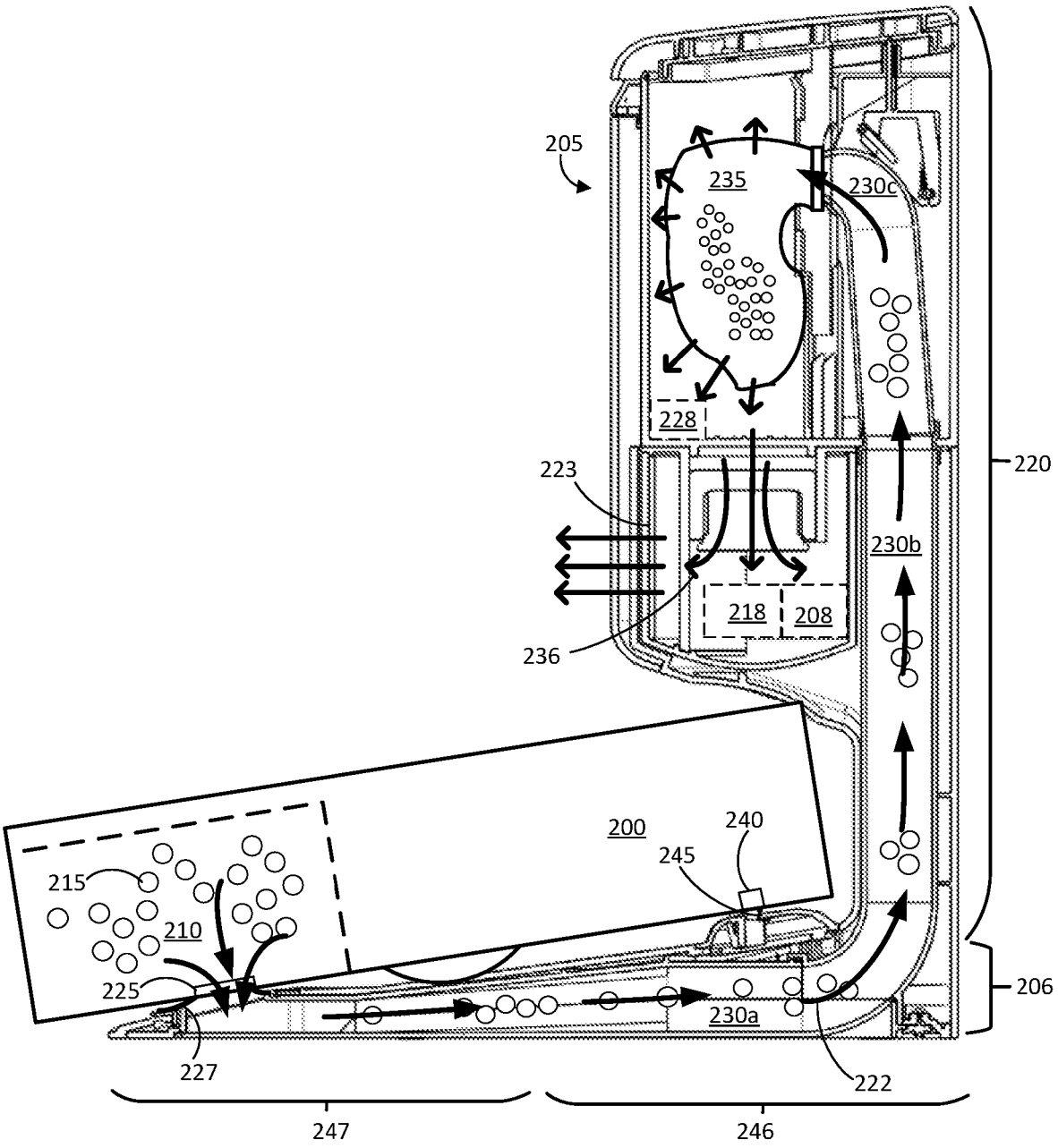
FIG. 2 is cross-sectional side view of an evacuation station and a mobile robot docked at the evacuation station.

FIG. 2 shows a cut-away side view of a mobile robot and an evacuation station of the type shown in FIG. 1. In FIG. 2, a mobile robot 200 is docked at an evacuation station 205, thereby enabling the evacuation station 205 and the mobile robot 200 to communicate with one another (e.g., electronically and optically), as described herein. The evacuation station 205, also depicted in FIG. 3, includes a base 206 to receive the mobile robot 200 to enable the mobile robot 200 to dock at the evacuation station 205. The mobile robot 200 may detect that its debris bin 210 is full, prompting the mobile robot 200 to dock at the evacuation station 205 so that the evacuation station 205 can evacuate the debris bin 210. The mobile robot 200 may detect that it needs charging, also prompting the mobile robot 200 to return to the evacuation station 205 for charging.

Both the mobile robot 200 and the evacuation station 205 include electrical contacts. On the evacuation station 205, the electrical contacts 245 are located along a rearward portion 246 of the base opposite to an intake port 227 located along a forward portion 247. The electrical contacts 240 on the mobile robot 200 are located on a forward portion of the mobile robot 200. Electrical contacts 240 on the mobile robot 200 mate to corresponding electrical contacts 245 on the base 206 when the mobile robot 200 is properly docked at the evacuation station 205. The mating between the electrical contacts 240 and the electrical contacts 245 enables communication between the control system 208 on the evacuation station and a corresponding control system of the mobile robot 200. The evacuation station 205 can initiate an evacuation operation and, in some cases, a charging operation, based on those communications. In other examples, the communication between the mobile robot 200 and the evacuation station 205 is provided over an infrared (IR) communication link. In some examples, the electrical contacts 245 on the mobile robot 200 are located on a back side of the mobile robot 200 rather than an underside of the mobile robot 200 and the corresponding electrical contacts 245 on the evacuation station 205 are positioned accordingly.

For example, when the electrical contacts 240, 245 are properly mated, the evacuation station 205 can issue a command to the mobile robot 200 to initiate evacuation of the debris bin 210. In some examples, the evacuation station 205 sends a command to the mobile robot 200 and will only evacuate if the mobile robot 200 completes a proper handshake (e.g., electrical contact between the electric contacts 240 and the electrical contacts 245). For example, the control system 208 can send a communication to the mobile robot 200, and receive a response to this communication from the mobile robot 200 and, in response, initiate an evacuation operation of the debris bin 210. Additionally or alternatively, when the electrical contacts 240, 245 are properly mated, the control system 208 can execute a charging operation to restore, wholly or partially, the power source of the mobile robot 200. In other examples, when the electrical contacts 240, 245 are properly mated, the mobile robot 200 can issue a command to the evacuation station 205 to initiate evacuation of the debris bin 210. The mobile robot 200 can transmit the command to the evacuation station 205 through electrical signals, optical signals, or other appropriate signals.

Also, when the electrical contacts 240, 245 are properly mated, the mobile robot 200 and the evacuation station 205 are aligned so that the evacuation station 205 can begin the evacuation operation. For example, the intake port 227 of the evacuation station 205 aligns with an exhaust port 225 of the debris bin 210. Alignment between the intake port 227 and the exhaust port 225 provides for continuity of a flow path 222, along which debris 215 travels between the debris bin 210 and a bag 235 in the evacuation station 205. As described herein, the debris 215 is suctioned by the evacuation station 205 from the debris bin 210 into the bag 235, where it is stored.

In this regard, the evacuation station includes a motor 218 connected to the canister 220. The motor 218 is configured to draw air out of the canister 220, and through bag 235, which is air permeable. As a result, the motor 218 can create a negative air pressure within the canister 220. The motor 218 responds to commands from the control system 208 to draw air out of the canister 220. The motor 218 expels the air drawn out of the canister 220 through an exit port 223 on the canister 220. As noted, the removal of air generates negative air pressure in the canister 220, which evacuates the debris bin 210 by generating an air flow along the flow path 222 that suctions the debris 215. In this example, the debris 215 moves along flow path 222 from the debris bin 210, through a door unit (not shown) on the debris bin 210, through the exhaust port 225 on the debris bin 210, through intake port 227 on the base 206, through multiple conduits 230*a*, 230*b*, 230*c* in the evacuation station 205, and into the bag 235.

Air is expelled by the motor 218 through an exhaust chamber 236 housing the motor 218 and through the exit port 223 into the environment. The bag 235 can be an air permeable filter bag that can receive the debris 215 travelling along the flow path 222—which can include flows of, for example, air and debris 215—and separate the debris 215 from air. The bag 235 can be disposable and formed of paper, fabric, or other appropriately porous material that allows air to pass through but traps the debris 215 within the bag 235. Thus, as the motor 218 removes air from the canister 220, the air passes through the bag 235 and exits through the exit port 223.

The evacuation station 205 also includes a pressure sensor 228, which monitors the air pressure within the canister 220. The pressure sensor 228 can include a Micro-Electro-Mechanical System (MEMS) pressure sensor or any other appropriate type of pressure sensor. A MEMS pressure sensor is used in this implementation because of its ability to continue to accurately operate in the presence of vibrations due to, for example, mechanical motion of the motor 218 or motion from the environment transferred to the evacuation station 205. The pressure sensor 228 can detect changes in air pressure in the canister 220 caused by the activation of the motor 218 to remove air from the canister 220. The length of time for which evacuation is performed may be based on the pressure measured by the pressure sensor 228, as described with respect to FIG. 4.

Figure 4:
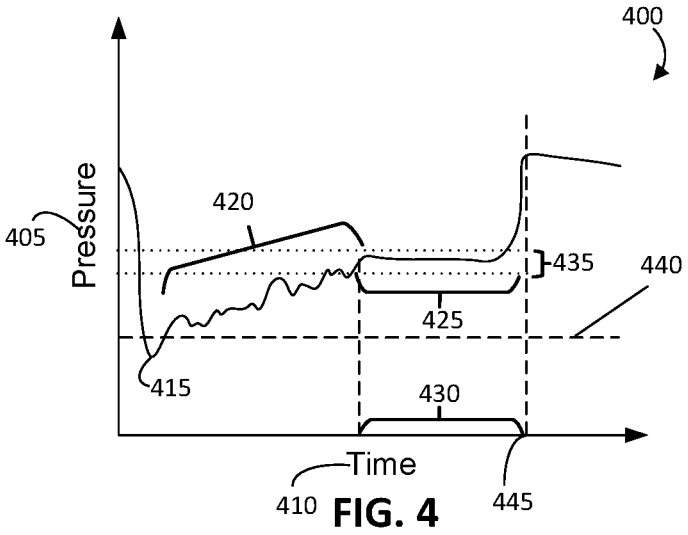
FIG. 4 is a graph of air pressure monitored over a period of time in a canister of the evacuation station of FIG. 2.

FIG. 4 depicts an example graph 400 of air pressure 405 generated over a period of time 410 in response to the removal of air from canister 220. The air pressure 405, before activation by motor 218, can be atmospheric air pressure. The initial activation of the motor 218 can cause an initial dip 415 in the air pressure 405. This initial dip 415 can occur due to a cracking pressure needed to initially open a flap or door of the door unit on the debris bin. More particularly, the initial dip 415 can be associated with the flap including a biasing mechanism that requires a first air pressure to move initially from a closed position to an open position that is higher than a second air pressure to maintain the flap in the open position.

As the motor 218 continues removing air and drawing debris 215 into the bag 235, fluctuations 420 may occur in the air pressure 405 due to the movement of the debris 215 through the flow path 222. That is, the debris 215 can cause partial occlusions of the flow path 222 that can cause the air pressure 405 to experience the fluctuations 420. The partial occlusions can cause the fluctuations 420 to include decreases in the air pressure 405. In some cases, during the evacuation operation, the air pressure 405 can clear the partial occlusions and decrease resistance to the air flow. The fluctuations 420 may thus include increase in the air pressure 405 after the partial occlusions are cleared. In addition, movement of the debris 215 within the bag 235 can cause changes in flow characteristics of the air, also resulting in the fluctuations 420. As the debris 215 continues filling the bag 235, the air pressure 405 increases due to the debris 215 impeding air flow through the canister 220.

When the debris 215 is mostly or completely evacuated from the debris bin 210, the bag 235 does not continue to fill with debris, thus resulting in a steady state 425 for the air pressure 405. In this context, steady state 425 may include a constant pressure or fluctuations relative to a constant pressure that do not exceed a certain percentage, e.g., 1%, 2%, 3%, 4%, 5%, 6%, 7%, 8%, 9%, etc., over the course of a period of time. The control system 208 can determine that the air pressure 405 has reached the steady state 425 by monitoring the air pressure 405 for a predefined period of time 430 following a start of evacuation. The air pressure 405 can be detected by the pressure sensor 228 which, in turn, can generate and transmit air pressure signals to the control system 208 for the processing. The control system 208 may use these pressure signals to determine when to terminate debris bin evacuation. In this regard, it can be advantageous to reduce the amount of evacuation time, since evacuation can be a relatively noisy process, and since evacuation time cuts-into cleaning time. Furthermore, in some cases, the majority of debris 215 is suctioned from the debris bin 210 within a fraction of the overall programmed evacuation time, making at least some of that time unnecessary. In some instances, the programmed evacuation time is 30 seconds, whereas the majority of debris is actually evacuated from the debris bin 210 within 5 seconds.

As shown in FIG. 4, upon entry into the steady state condition 425, the control system 208 continues to control the motor 218 to cause the motor 218 to continue to apply the negative air pressure. This negative air pressure is applied for the predefined period of time 430, during which the air pressure 405 is maintained within a predefined range 435 (e.g., a range defined by a two-sided hysteresis). After that predefined period of time 430, if the air pressure 405 remains stable (e.g., within the predefined range 435), the control system 208 sends commands to stop operation of the motor 218, thereby terminating evacuation. The motor 218 then stops removing air from the canister 220, causing the air pressure 405 to return to atmospheric pressure. The predefined period of time 430 can be, for example, 3 seconds, 4 seconds, 5 seconds, 6 seconds, 7 seconds, 8 seconds, 9 seconds, 10 seconds, 11 seconds, 12 seconds, 13 seconds, 14 seconds, 15 seconds, etc. The predefined range 435 can be, for example, plus or minus 5 Pa, 10 Pa, 15 Pa, 20 Pa, etc. The predefined period of time 430 and the predefined range can be stored on a memory storage element operable with the control system 208.

In some implementations, the steady state air pressure 405 can decrease below a threshold pressure 440, which indicates that the bag 235 has become substantially full of debris. In some implementations, as atmospheric conditions, debris, and other conditions will vary, the trend in the steady state air pressure 405 over multiple evacuations would be used to indicate that the bag 235 has become substantially full of debris. A combination of a threshold pressure 440 and the trend of the steady state air pressure 405 is used in some implementations. The steady state air pressure 405 decreases as the bag 235 fills and it becomes more difficult to pull air through the bag 235. The threshold pressure 440 can be pre-determined (e.g., stored in a memory storage element accessible by the control system 208) or it can be adjusted by the control system 208 based on a baseline reading of the steady state air pressure 405 when a new bag 235 is installed. The control system 208 can determine, for example, when the steady state air pressure 405 is below the threshold pressure 440, the trend in the steady state air pressure 405 over multiple evacuations is sufficiently sloped, or any combination thereof, and can then transmit instructions for an operation in response to the air pressure 405 exceeding the threshold pressure 440. For example, the control system 208 can transmit commands to the motor 218 to end evacuation of the debris 215, thus causing the air pressure 405 to return to atmospheric pressure. The threshold pressure 440 can between, for example, 600 Pa to 950 Pa, but this will depend on conditions in the system and environment. The threshold pressure 440 can indicate percent volume of the bag 235 occupied by the debris 215 between, for example 50% and 100%. Upon detecting that the bag 235 is full, the control system 208 can also output instructions to a computer system, such as a server, which maintains a user account and which can notify the user that the bag is full and needs to be changed. For example, the server can output the information to an application ("app") on the user's mobile device, which the user can access to monitor their home system. In some examples, a second threshold pressure (e.g., a notification pressure) can be used to notify the user that the bag 235 is nearing the full state and a limited number of additional evacuations will be possible prior to replacement of the bag 235. Thus, the system can notify the user and allow the user to replace the bag 235 prior to the bag 235 being too full to allow evacuation of the robot bin.

By monitoring the air pressure 405 in the canister 220 using the pressure sensor 228, the control system 208 can adaptively control an amount of evacuation time 445 that the control system 208 operates the motor 218 and, therefore, the amount of time that evacuation of the debris bin 210 occurs. For example, the point in time when the air pressure 405 exceeds the threshold pressure 440 and/or the point in time when the air pressure 405 is maintained within the predefined range 435 for the period of time 430 can dictate when evacuation ends. In some implementations, the control system 208 can control the evacuation time 445 to be between 15 seconds and 45 seconds. The air pressure 405, and thus the evacuation time 445, can depend on a number of factors such as, but not limited to, an amount of debris stored in the debris bin 210 and flow characteristics caused by, e.g., the size, viscosity, water content, weight, etc. of the debris 215.

Figure 5:
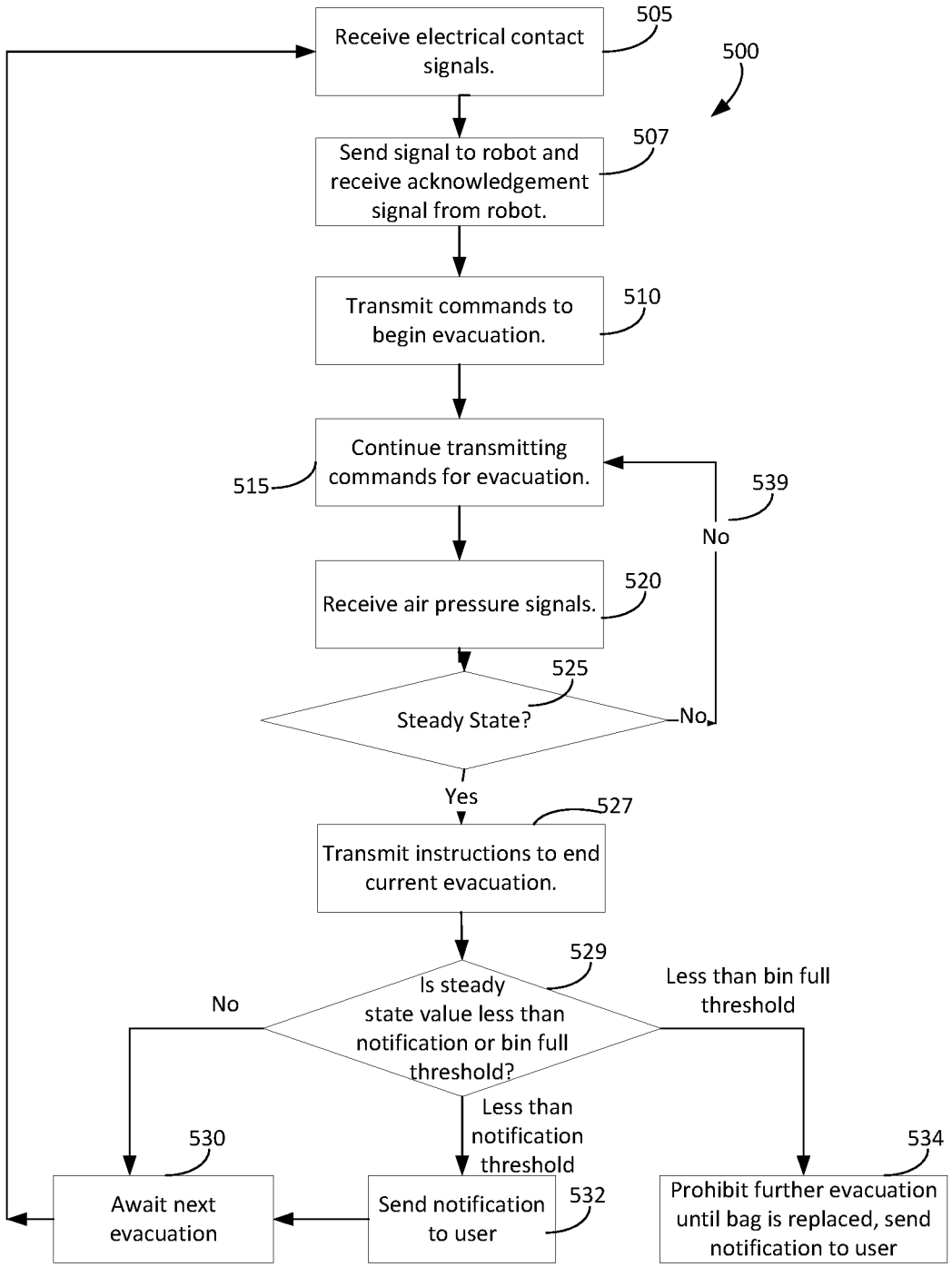
FIG. 5 is a flow chart of a process to operate an evacuation station.

FIG. 5 shows a flow chart of an example process 500 in which a control system (e.g., the control system 208) operates a motor (e.g., the motor 218) of an evacuation station (e.g., the evacuation station 205) based on electrical contact signals and air pressure (e.g., the air pressure 405) in a canister (e.g., the canister 220) of the evacuation station.

At the start of the process 500, the control system receives (505) electrical contact signals. The electrical contact signals indicate that a mobile robot is docked at the evacuation station. In some examples, the electrical contact signals can indicate that electrical contacts of a mobile robot are in electrical and physical contact with electrical contacts of the evacuation station.

After receiving the electrical contact signals, the control system sends (507) optical start signals to initiate evacuation via, for example, an optical communication link. In some cases, the mobile robot transmits the optical start signals using the optical communication link. Because the electrical contacts of the mobile robot are in contact with the electrical contacts of the evacuation station, the mobile robot is properly aligned with the evacuation station for the evacuation station to initiate the evacuation process by transmitting the optical start signals directly to the mobile robot. The mobile robot acknowledges the start optical signal with an acknowledgement optical signal to the evacuation station before the control system begins evacuation.

The control system then transmits (510) commands to begin evacuation. The control system can transmit (510) the commands to begin evacuation after receiving the optical acknowledgement signal from the mobile robot to begin the evacuation. In some examples, the evacuation station detects the received (505) electrical contact signals and transmits (510) commands to begin the evacuation after detecting the received (505) electrical contact signals. The evacuation station thus does not receive optical start signals from the mobile robot to begin evacuation. In some implementations, the control system does not receive (505) electrical contact signals when the electrical contacts mate. The controller of the mobile robot can receive the electrical contact signals and then transmit the optical start signals to the control system in response to the electrical contact signals.

The commands transmitted (510) by the control system can instruct the motor to activate as described herein. Specifically, the motor suctions air out of the canister of the evacuation station to generate a negative air pressure within the canister. The resulting negative air pressure extends along the flow path and into the robot's debris bin, causing suction of the debris from the robot's debris bin, through the flow path, and into an air permeable bag held in the canister.

The control system continues transmitting (515) the commands, thereby continuing operation of the motor and evacuation of debris. During operation of the motor, the control system can modify the power delivered to the motor to increase or decrease the amount of negative air pressure generated within the canister.

The control system continues to receive (520) air pressure signals from the pressure sensor in the canister while evacuation continues. The measured air pressure signals vary due to variations in amounts of debris within the bag, blockage of the flow path, or the like.

Based on the air pressure signals, the control system determines (525) whether the air pressure within the canister has reached steady state. To determine (525) whether the air pressure has reached steady state, the control system determines that it has received air pressure signals indicating a pressure within a defined range for at least predefined amount of time. If the control system determines that the air pressure has been in the steady state for the predefined amount of time, the control system can transmit (527) commands to end evacuation. If the control system determines (539) that the air pressure has not reached steady state air pressure, the control system can continue transmitting (515) commands for evacuation, receive (520) air pressure signals, and determine (525) whether to transmit (527) instructions to end evacuation. In other examples, the control system can have a pre-set evacuation time (length of evacuation). In such situations, the control system does not determine the completion of evacuation based on the pressure sensor signals.

The system also determines (529) whether the steady state air pressure is (a) indicative of a non-full bag condition (b) in a range for notification of a bag that is reaching a full state, or (c) indicative of a bag full condition based on a comparison of the steady state air pressure to a threshold. If the control system determines that the air pressure exceeds both the notification and bag full threshold pressures, the control system awaits (530) the next evacuation process. If the control system determines (529) that the air pressure is below the notification threshold but above the bag full threshold pressure, the control system transmits (532) a notification to the user indicating that the bag is close to being full. If the control system determines (529) that the air pressure is below the bag full threshold pressure, the control system transmits (532) a notification to the user indicating that the bag is full and prohibits (534) further evacuation of the bin until the bag is replaced.

As described herein, motor 218 generates negative air pressure in the canister 220 to create air flow along the flow path 222 to carry the debris 215 from the debris bin 210 to the bag 235 held in the canister 220. And, as described herein with respect to, for example, FIGS. 4 and 5, the control system 208 uses air pressure monitored by the pressure sensor 228 to determine the evacuation time 445 that the control system 208 activates the motor 218 to evacuate the bag 235. Thus, sealing the air pressure of the canister 220 and the multiple conduits 230*a*, 230*b*, 230*c* from the environment can be advantageous so that the motor 218 operates more efficiently and so that the air pressure detected by the pressure sensor 228 can predictably inform the control system 208 of status of the evacuation operation.

Figure 3:
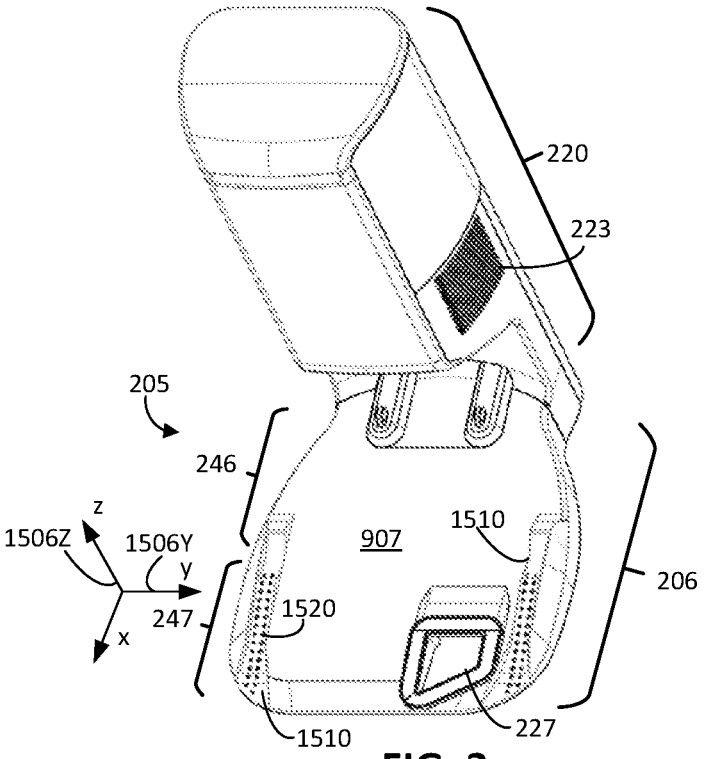
FIG. 3 is a top perspective view of the evacuation station of FIG. 2.
Figure 6:
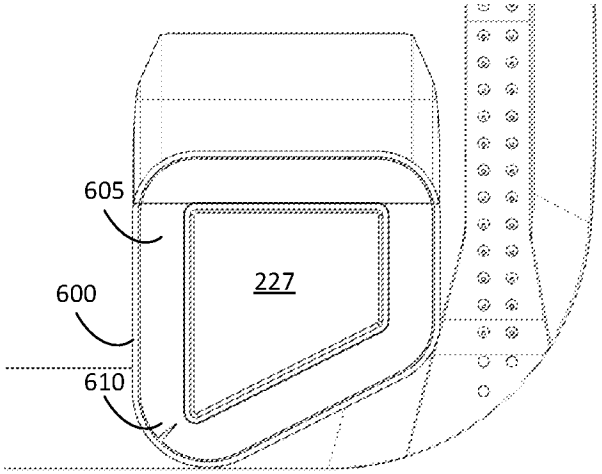
FIG. 6 is a top view of a seal of the evacuation station of FIG. 2.
Figure 7:
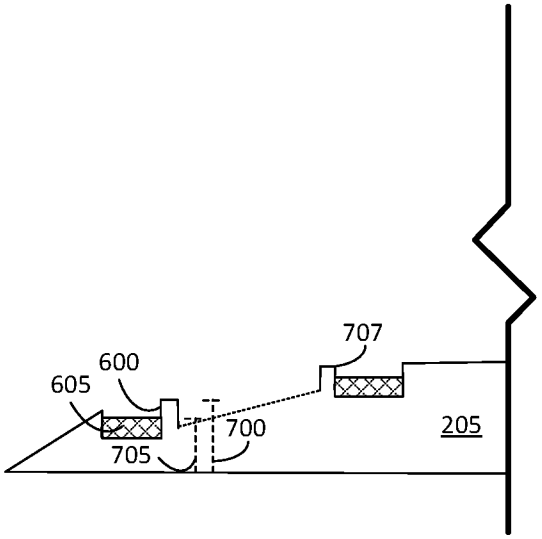
FIG. 7 is a cross-sectional side view of the seal of FIG. 6.

In some examples as shown in FIGS. 3, 6 and 7, the intake port 227 of the evacuation station 205 includes a rim 600 defining a perimeter of the intake port 227 and a seal 605 inside of the rim 600. The seal 605 is disposed within the intake port 227, and is below the rim 600 (e.g., between 0.5-1.5 mm below the rim). However, the seal 605 is not fixed relative to the intake port 227 or the rim 600, and is movable relative thereto, e.g., in response to negative air pressure experienced through the flow path. The rim 600 can be located at a forward portion 247 of the evacuation station 205 so that, when the mobile robot 200 docks at the evacuation station 205, the intake port 227 aligns with the exhaust port 225 of the debris bin 210.

Figure 8:
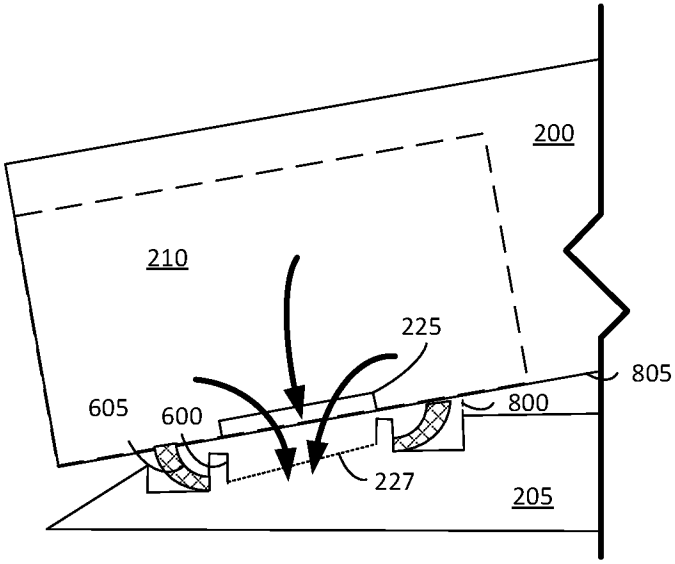
FIG. 8 is a cross-sectional side view of the seal of FIG. 7 with the mobile robot docked at the evacuation station of FIG. 2.

In the absence of the negative air pressure such as when the mobile robot 200 is not docked at the evacuation station 205, as shown in FIG. 7, the seal 605 is protected from contact and frictional forces due to the mobile robot 200 docking at the evacuation station 205. The geometry of the rim 600 and the seal 605 can reduce wear of the rim 600 and the seal 605 when the mobile robot 200 moves over the rim 600 to dock at the evacuation station 205. A height 700 of the rim 600 is greater than a height 705 of the seal 605 such that, when the mobile robot 200 passes over the rim 600, the underside of the mobile robot 200 does not contact the seal 605. In the absence of the negative air pressure, the height 705 of the seal 605 is thus below an upper surface 707 of the rim 600. The height 700 can also be less than a clearance 800 of an underside 805 of the mobile robot 200, as shown in FIG. 8. As a result, the mobile robot 200 can pass over the rim 600 when the mobile robot 200 docks at the evacuation station 205.

The seal 605 may be made of a deformable material that can be movable relative to the rim 600 in response to forces caused by, for example, the negative air pressure generated by the motor 218. The material can be, for example, a thin elastomer. In some implementations, the elastomer ethylene propylene diene monomer (EPDM) rubber, silicone rubber, polyether block amides, Chloropene rubber, Butyl rubber, among other elastomeric materials. In the presence of the negative air pressure in the flow path during an evacuation operation, the seal 605 can respond to the negative air pressure generated during the evacuation operation by moving upward, toward the mobile robot 200, and deforming to form an air-tight seal with the mobile robot 200. In an example, the seal 605 conforms to a shape of the mobile robot 200 in an area surrounding the exhaust port 225 of the debris bin 210. The seal 605 has a width that is relative to the separation between the evacuation station 205 and the mobile robot 200 when the mobile robot 200 is located on the evacuation station 205 such that the seal 605 can extend upwardly to contact the underside 805 of the mobile robot 200 (e.g., 0.5 cm to 1.5 cm)

As shown in FIG. 6, in some examples, the seal 605 includes one or more slits 610 that allow the seal 605 to deform upward at corners of the seal 605 without generating excessive hoop stress in the seal 605 due to the upward deformation. The slit 610 can thus increase a lifespan of the seal 605 and increase the number of or duration of evacuation operations executed by the evacuation station 205.

The seal 605 and the rim 600 cooperate to provide an air-tight seal between the debris bin 210 and the evacuation station 205 that is durable. In some implementations, the seal 605 can be replaceable. A user can remove the seal 605 from the rim 600 and replace the seal 605.

Figure 9:
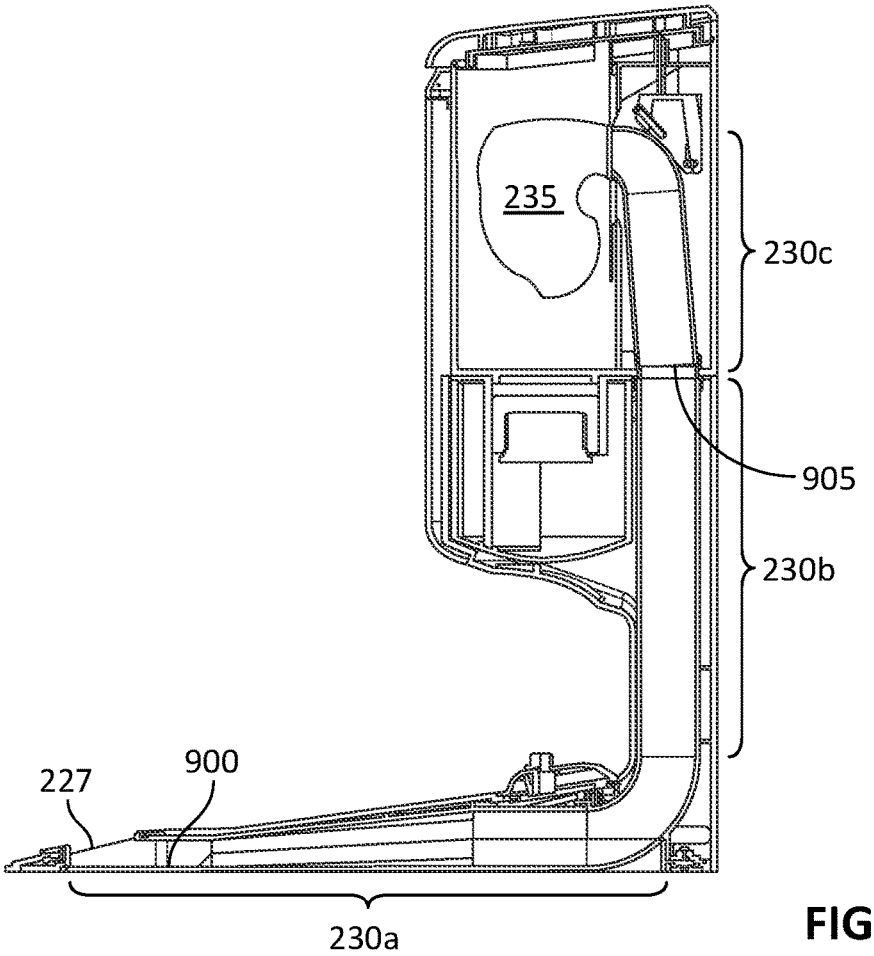
FIG. 9 is a cross-sectional side view of the evacuation station of FIG. 2.

In some implementations, each of the conduits 230*a*, 230*b*, 230*c*, in addition to providing a continuous flow path 222 for transporting debris, can include features that improve ease of operation, manipulation, and cleaning of the evacuation station 205. As shown in FIGS. 2 and 9, for example, the conduit 230*a* extends partly along a bottom 900 of the base 206. In some cases, the conduit 230*a* extends partly upward (e.g., along the z-axis) along the evacuation station 205, connecting the debris bin 210 to the conduit 230*b*. The conduit 230*b* extends upward from the conduit 230*a*, connecting the conduit 230*a* to the conduit 230*c*. Flexible grommets 905 connect the conduit 230*b* to the conduit 230*c*. The conduit 230*c* extends upward from the conduit 230*b* and connects the conduit 230*c* to the bag 235.

Figure 10:
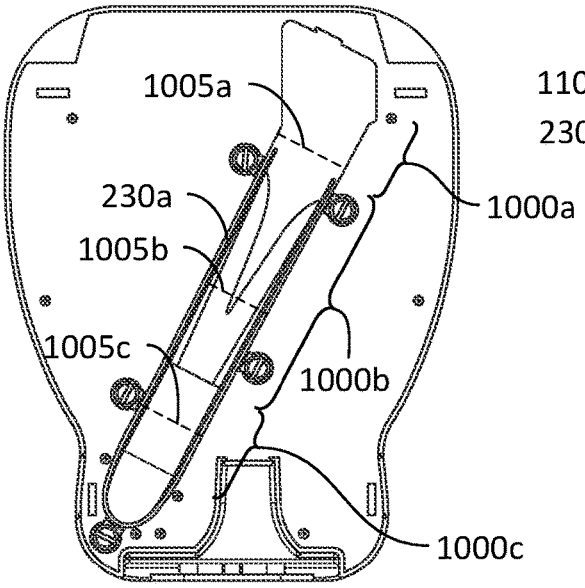
FIG. 10 is a bottom view of a base of the evacuation station of FIG. 2.

The conduit 230*a* can be sized, and dimensioned, such that a ramp 907, shown in FIG. 3 and described herein, can have a lower height along the forward portion 247. In an example, the conduit 230*a* can have a cross-sectional shape that transitions from at least partly rectangular to at least partly curved. As shown in FIG. 10, a portion 1000*a* of the conduit 230*a* adjacent to the intake port 227 can have a cross-sectional shape 1005*a* that is rectangular, and a portion 1000*c* of the conduit 230*a* adjacent to the canister 220 can have a cross-sectional shape 1005*c* that is either circular or at least partly curved. In some implementations, the cross-sectional shape 1005*c* is partly circular. A portion 1000*b* of the conduit 230*a* can have a transitional cross-sectional shape 1005*b* that gradually transitions from the cross-sectional shape 1005*a* to the cross-sectional shape 1005*c* to reduce sharp geometries within the conduit 230*a*. The transitional cross-sectional shape 1005*b* can be partly curved, partly rectangular, partly circular, or combinations thereof. The cross-sectional shape 1005*a* can have a smaller height than the cross-sectional shape 1005*b* and the cross-sectional shape 1005*c* so that the ramp 907 can have increasing height going from the forward portion 247 toward the rearward portion 246.

The conduit 230*a* can include cross-sectional areas that remain constant between the intake port 227 and the conduit 230*b* to facilitate non-turbulent air flow through the flow path 222. The cross-sectional area of the cross-sectional shapes 1005*a*, 1005*b*, 1005*c* can be substantially constant throughout the length of the conduit 230*a* to reduce influence of geometry on flow characteristics through the conduit 230*a*.

The conduit 230*a* can be a transparent, removable conduit and/or a replaceable conduit in order to facilitate cleaning the debris 215 from the evacuation station 205. A user can remove the conduit 230*a* and clean an interior of the conduit 230*a* to remove, for example, debris clogs trapped within the conduit 230*a*. The conduit 230*a* can be fastened to the base 206 using removable fasteners, such as, for example, screws, reversible snap fits, tongue and groove joints, and other fasteners. The user can remove the fasteners and then remove the conduit 230*a* from the base 206 to clean the interior of the conduit 230*a*.

The conduits 230*b*, 230*c* includes pipes that move relative to one another. In an example, the conduit 230*b* is a stationary pipe, and the conduit 230*c* is a movable pipe. Referring to FIG. 9, a flexible grommet 905 provides a flexible interface between the conduit 230*b* and the conduit 230*c*. In some implementations, the evacuation station 205 can include one or more flexible grommets 905. The conduit 230*c* pivots at the interface between the conduit 230*c* and the conduit 230*b* because of the flexibility of the grommet 905.

Figure 11:
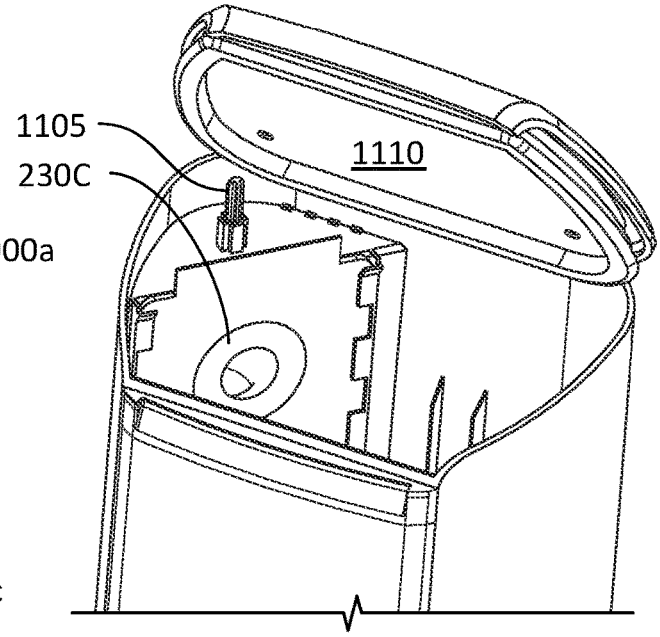
FIG. 11 is a top perspective view of a canister of the evacuation station of FIG. 2.
Figure 12:
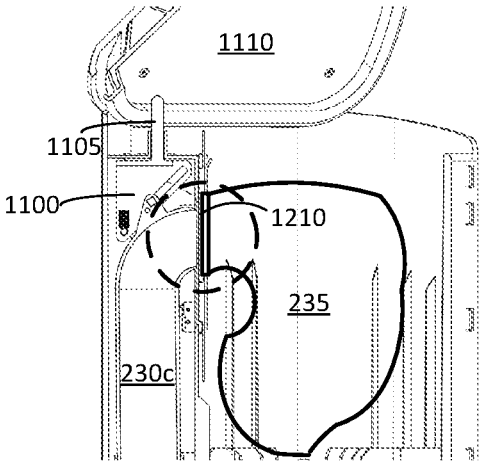
FIG. 12 is a cross-sectional side view of the canister of FIG. 11 with a top of the canister in an open position.
Figure 13:
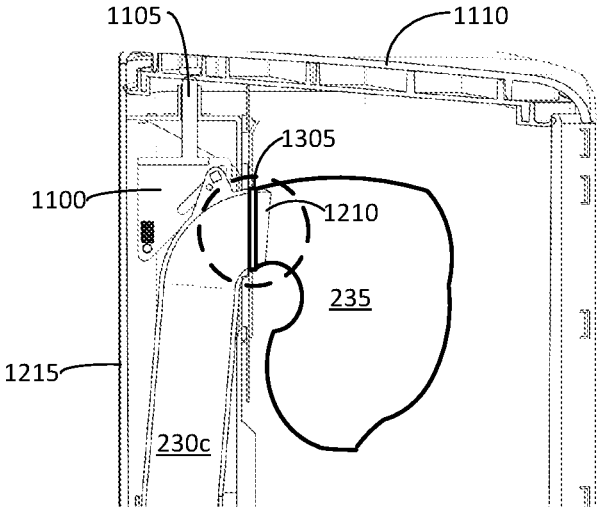
FIG. 13 is a cross-sectional side view of the canister of FIG. 11 with the top of FIG. 12 in a closed position.

The conduit 230*c* can be moved into position to interface with the bag 235 to establish the continuous flow path 222 between the debris bin 210 and the bag 235. In some implementations, as shown in FIGS. 11 to 13, to move the conduit 230*c* relative to the conduit 230*b*, the evacuation station 205 can include a cam mechanism 1100 (shown in FIGS. 12 and 13) and a plunger 1105 located within the canister 220. The cam mechanism 1100 can include levers, cams, shuttles, and other components to transfer kinematic motion from the plunger 1105 to the conduit 230*c*. The plunger 1105 can be an elongate component that moves axially (e.g., along the z-axis 1506Z of FIG. 3).

The cam mechanism 1100 controls movement of the conduit 230*c* based on movement of the plunger 1105 of the evacuation station 205. In this regard, a top 1110 of the canister 220 can be movable between an open position (FIG. 12), and a closed position (FIG. 13). Movement of the top 1110 from the open position to the closed position actuates the plunger 1105 which in turn causes the cam mechanism 1100 to move the conduit 230*c* relative to the conduit 230*b*. Moving the top 1110 from the open position (FIG. 12) to the closed position (FIG. 13) causes the conduit 230*c* to move from the receded position (circled in FIG. 12) in which the conduit 230*c* does not interface with the bag 235 to the extended position (circled in FIG. 13) in which the conduit 230*c* does interface with the bag 235. Thus, the conduit 230*c* can be movable out of contact with the bag 235 in response to moving the top 1110 into the open position (FIG. 12). In addition, the conduit 230*c* can be movable into contact with the bag 235 in response to movement of the plunger 1105. When the conduit 230*c* is contact with the bag 235, the conduit 230*c* can make a substantially airtight seal to a latex membrane 1305 of the bag 235. As a result, the conduit 230*c* can create a path (e.g., the continuous flow path 222 through the conduits 230*a*, 230*b*, 230*c*) for the debris 215 and the air to pass between the debris bin 210 and the bag 235. In some cases, the canister can include alignment features, such as slots 1112, that align the bag 235 with the bag interface end 1210 of the conduit 230*c*.

The mechanisms of the top 1110 and the conduit 230*c* may provide the user a convenient way to load the bag 235 in the evacuation station 205, and to remove the bag from the evacuation station. Before the bag 235 is placed into the canister 220, the user can open the top 1110 (FIG. 12), causing the conduit 230*c* to move into the receded position (FIG. 12). The user can then place the bag 235 into the canister 220 such that the bag 235 is aligned with the conduit 230*c*. The user can close the top 1110 (FIG. 13), causing the conduit 230*c* to move into the extended position (FIG. 13). The bag interface end 1210 of the conduit 230*c* can connect with the bag 235, thus interfacing the bag 235 with the conduit 230*c*. Thus, the user can incorporate the bag 235 into the flow path 222 without significantly manually manipulating the bag 235 and the bag interface end 1210 of the conduit 230*c*.

Figure 14:
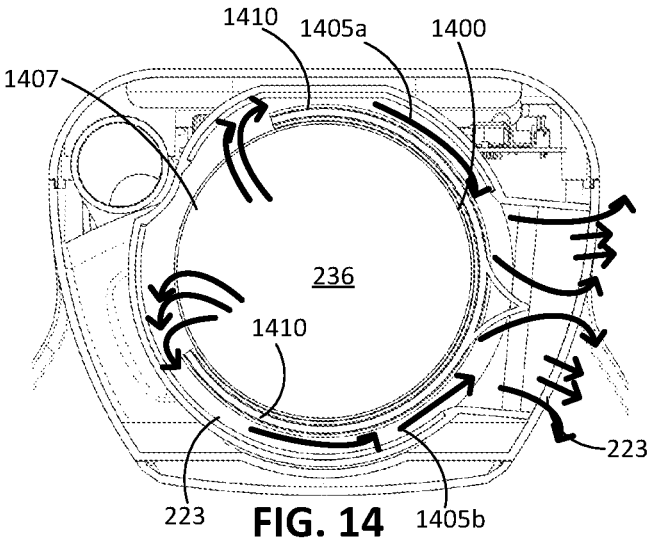
FIG. 14 is a cross-sectional top view of an exhaust chamber of the evacuation station of FIG. 2.

As described herein, while the debris 215 is trapped within the bag 235, air continues flowing through the bag 235 into the exhaust chamber 236. As shown in FIG. 14, the exhaust chamber 236 includes a motor housing 1400 that houses the motor 218 (not shown in FIG. 14). Thus, the air exiting through the exit port 223 carries energy associated with noise of the motor 218.

The exhaust chamber 236 can include features to reduce or decrease the amount of noise caused by the motor 218. As shown in FIG. 14, in the exhaust chamber 236 of the canister 220, the air takes two split flow paths 1405*a* and 1405*b* out through the exit port 223. The split flow paths 1405*a*, 1405*b* exit through a portion 1407 of the motor housing 1400. The portion 1407 faces away from the exit port 223 to extend the distance that air travels between the motor 218 and the exit port 223. In some cases, the canister 220 further includes foam insulation 1410 adjacent the split flow paths 1405*a*, 1405*b* that absorb sound as the air travels along the split flow paths 1405*a*, 1405*b*. The split flow path 1405*a*, 1405*b* and the foam insulation 1410 can together reduce the noise caused by the motor 218.

Figure 15:
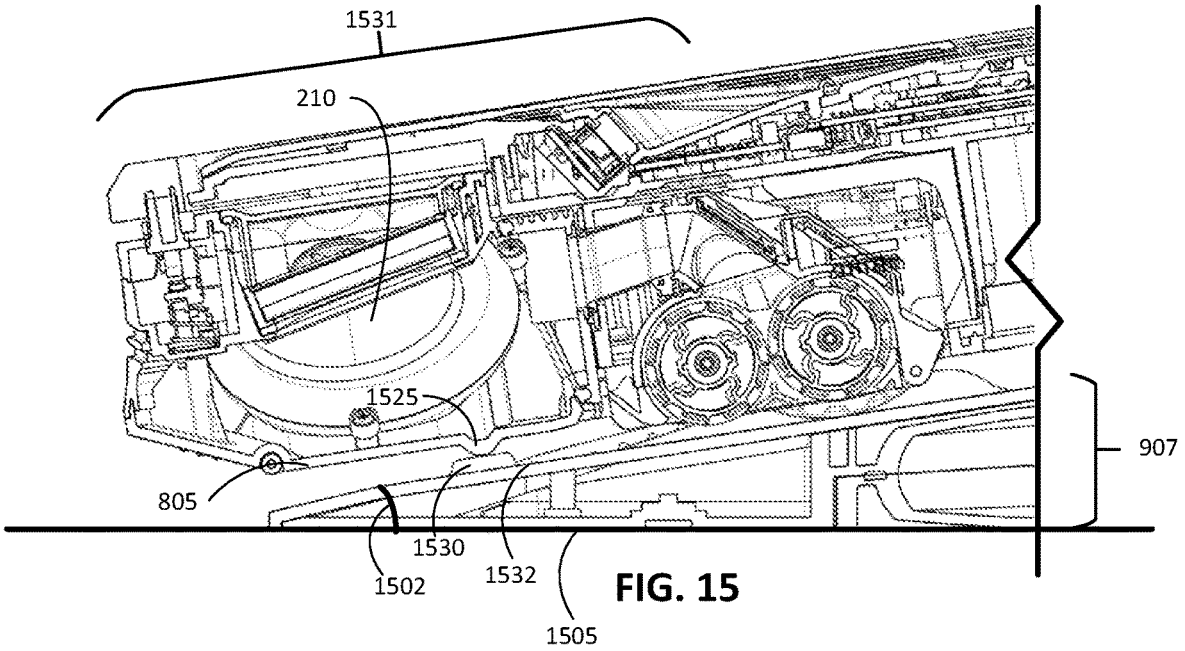
FIG. 15 is a cross-sectional side view of a ramp of the evacuation chamber of FIG. 2.

The evacuation station 205 can include additional features that affect evacuation operation of the evacuation station 205. In an example, the ramp 907, as shown in FIG. 3 and FIG. 15, assists with guiding debris 215 towards the intake port 227. The ramp 907 forms an angle 1502 with a surface 1505 on which the evacuation station 205 rests. Thus, the ramp 907 increases in height relative to the surface 1505. The angle 1502 allows gravity to cause debris 215 residing in the debris bin 210 to gather at toward the back of the debris bin 210 closer to the exhaust port 225 of the debris bin 210 when the mobile robot 200 docks at the evacuation station 205. During evacuation, as the negative air pressure loosens and suctions the debris 215, gravity also assists in moving the debris 215 toward the exhaust port 225 into the flow path 222. Thus, the angle of the ramp 907 can expedite the evacuation operation.

In some examples, the evacuation station 205 can include features to assist in proper alignment and positioning of the mobile robot 200 relative to the evacuation station 205. For horizontal alignment (e.g., alignment along a y-axis 1506Y shown in FIG. 3) of the mobile robot 200 with the evacuation station 205, the ramp 907 can include wheel ramps 1510 (shown in FIG. 3) that are sized and shaped appropriately to receive wheels of the mobile robot 200. When the mobile robot 200 navigates up the ramp 907, the wheels of the mobile robot 200 align with the wheel ramps 1510. The wheel ramps 1510 can include traction features 1520 (shown in FIG. 3) that can increase traction between the mobile robot 200 and the ramp 907 so that the mobile robot 200 can navigate up the ramp 907 and dock at the evacuation station 205.

For vertical alignment (e.g., alignment along a z-axis 1506Z shown in FIG. 3), the evacuation station 205 can include, as shown in FIG. 15, a robot stabilization protrusion 1525 on the mobile robot 200 that contacts a robot stabilization protrusion 1530 on the ramp 907. When the mobile robot 200 docks at the evacuation station 205, the robot stabilization protrusions 1525, 1530 thus can maintain contact between the electrical contacts 240 of the mobile robot 200 with the electrical contacts 245 of the evacuation station 205. The robot stabilization protrusion 1530 on the ramp 907 is located between a surface 1532 on the ramp 907 and the underside 805 of the mobile robot 200. In some implementations, the ramp 907 can include two or more robot stabilization protrusions 1530 and/or two or more robot stabilization protrusions 1525.

During the evacuation operation, the negative air pressure results in a force applied to a rear portion 1531 of the mobile robot 200. The force can cause motion of portions of the mobile robot 200 along the z-axis 1506Z. For example, a frontward portion (not shown in FIG. 15) may lift off of the ramp 907, thus potentially resulting in misalignment between the electrical contacts 240 and the electrical contacts 245. Contact between the robot stabilization protrusion 1525 and the robot stabilization protrusion 1530 can reduce motion of the mobile robot 200 caused by the force resulting from negative air pressure that can cause the mobile robot 200 to lift off of the ramp 907. As a result, the electrical contacts 240 can remain in contact with the electrical contacts 245 so that the evacuation operation continues uninterrupted.

The evacuation stations (e.g., the evacuation station 205) described herein can be used with a number of types of mobile robots that include bins to store debris. The evacuation stations can evacuate the debris from the bins.

Figure 16:
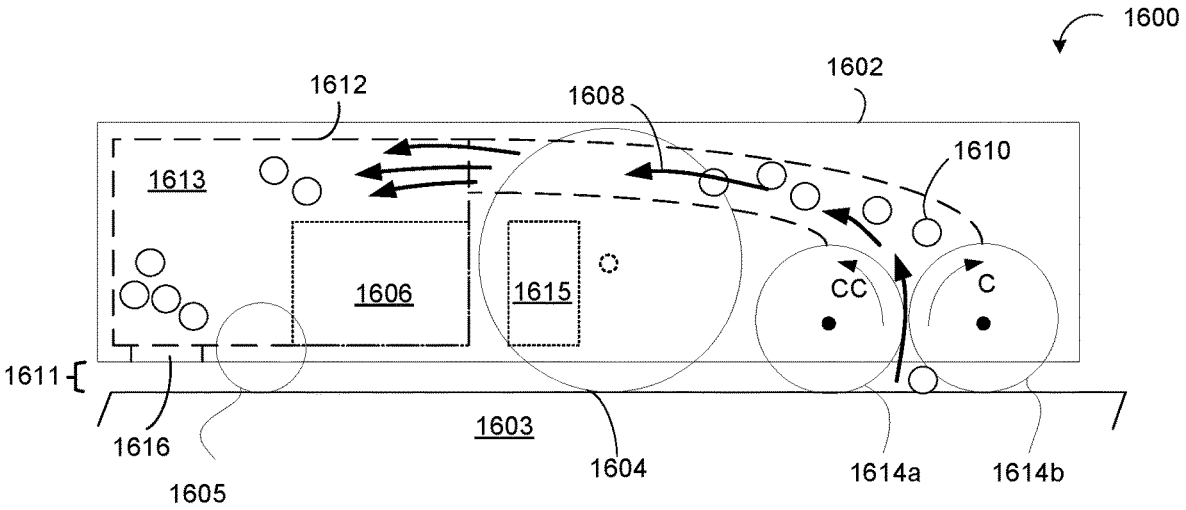
FIG. 16 is a schematic side view of an example mobile robot.

In an example, as shown in FIG. 16, a mobile robot 1600 can be a robotic vacuum cleaner that ingests debris from a floor surface. The mobile robot 1600 includes a body 1602 that navigates about a floor surface 1603 using drive wheels 1604. A caster wheel 1605 and the drive wheels 1604 support the body 1602 over the floor surface 1603. The drive wheels 1604 and the caster wheel 1605 can support the body 1602, and hence a debris bin 1612 (e.g., the debris bin 210), such that the debris bin 1612 is supported a clearance distance 1611 between 3 and 15 mm above the surface 1603.

The mobile robot 1600 ingests debris 1610 (e.g., the debris 215) using a suction mechanism 1606 to generate an air flow 1608 that causes the debris 1610 on the floor surface 1603 to be propelled into the debris bin 1612. The suction mechanism 1606 can thus suction debris 1610 from the floor surface 1603 into the debris bin 1612 during traversal of the floor surface 1603. The body 1602 supports a front roller 1614*a* and a rear roller 1614*b* that cooperate to retrieve debris 1610 from the surface 1603. More particularly, the rear roller 1614*b* rotates in a counterclockwise sense CC, and the front roller 1614*a* rotates in a clockwise sense C. As the front roller 1614*a* and the rear roller 1614*b* rotate, the mobile robot 1600 ingests the debris and the air flow 1608 causes the debris 1610 to flow into the debris bin 1612. The debris bin 1612 includes a chamber 1613 to hold the debris 1610 received by the mobile robot 1600.

A control system 1615 (implemented, e.g., by one or more processing devices) can control operation of the mobile robot 1600 as the mobile robot 1600 traverses the floor surface 1603. For example, during a cleaning operation, the control system 1615 can cause motors (not shown) to rotate the drive wheels 1604 to cause the mobile robot 1600 to move across the floor surface 1603. The control system 1615, during the cleaning operation, can further activate motors to cause rotation of the front roller 1614*a* and the rear roller 1614*b* and to activate the suction mechanism 1606 to retrieve the debris 1610 from the floor surface 1603.

The debris bin 1612 provides an interface between the chamber 1613 and an evacuation station (e.g., the evacuation station 205) such that the evacuation station can evacuate the debris 1610 stored in the chamber 1613 and the debris bin 1612. The debris bin 1612 includes an exhaust port 1616 (e.g., the exhaust port 225) through which debris 1610 can exit the chamber 1613 of the debris bin 1612 into the evacuation station.

Figure 17:
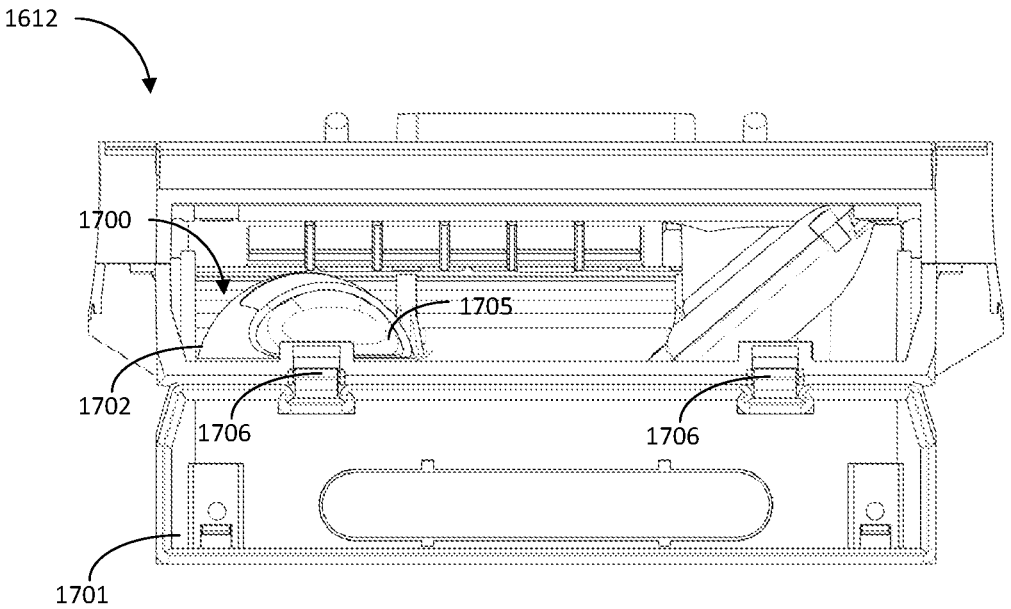
FIG. 17 is a front view of a debris bin for the mobile robot of FIG. 16 with a bin door in an open position.
Figure 18:
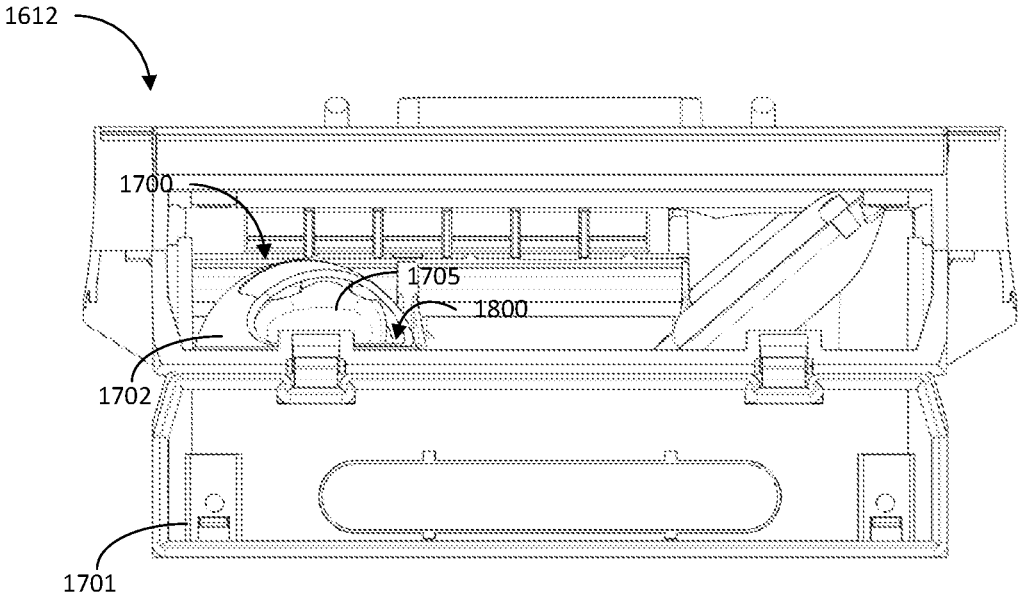
FIG. 18 is a front view of the debris bin of FIG. 17 with the bin door in a closed position.

In FIGS. 17 to 18, a bin door 1701 is open so that an evacuation door unit 1700 is visible. During the cleaning operation and the evacuation operation, the bin door 1701 is typically closed. The user can open the bin door 1701 by rotating the bin door 1701 about hinges 1706 to manually empty debris 1610 from the debris bin 1612.

As shown in FIGS. 17 and 18, the evacuation door unit 1700 of the debris bin 1612 can include a flap (also referred to as a door) 1705 that opens and closes to control flow of the debris 1610 between the chamber 1613 and external devices. The door unit 1700 includes a support structure 1702 disposed within the debris bin 1612. The support structure 1702 can be semi-spherical. The door unit 1700 is located over the exhaust port 1616. The flap 1705 is configured to move between a closed position shown in FIG. 17 and an open position shown in FIG. 18. The flap 1705 is mounted on the support structure 1702. The flap 1705 moves from the closed position to the open position in response to a difference in air pressure at the exhaust port and within the debris bin 1612. As described herein, the evacuation station can generate a negative air pressure, thus causing the air in the debris bin 1612 to generate an air pressure that moves the flap 1705 from the closed position (FIG. 17) to the open position (FIG. 18). In the closed position (FIG. 17), the flap 1705 blocks air flow between the debris bin 1612 and the environment. In the open position (FIG. 18), the flap 1705 provides a path 1800 between the debris bin 1612 and the exhaust port 1616.

Figure 19A:
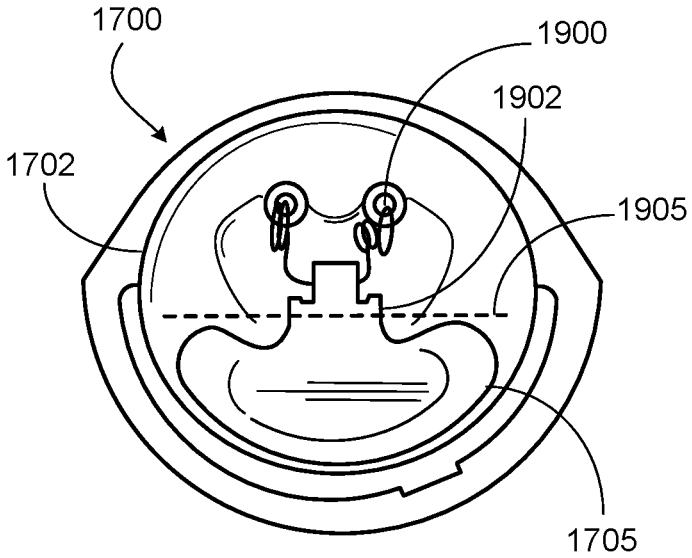
FIG. 19A is a bottom perspective view of a door unit for a debris bin.

The door unit 1700 can include a biasing mechanism that biases the flap 1705 into the closed position (FIG. 17). In an example, as shown in FIG. 19A, which depicts an underside of the door unit 1700, a torsion spring 1900 biases the flap 1705 into the closed position (FIG. 17). The flap 1705 rotates about a hinge 1902 having a rotational axis 1905, and the torsion spring 1900 applies force that generates a torque about the axis 1905 that biases the flap 1705 into the closed position (FIG. 17). The hinge 1902 connects the flap 1705 to the support structure 1702 of the door unit 1700.

Figure 19B:
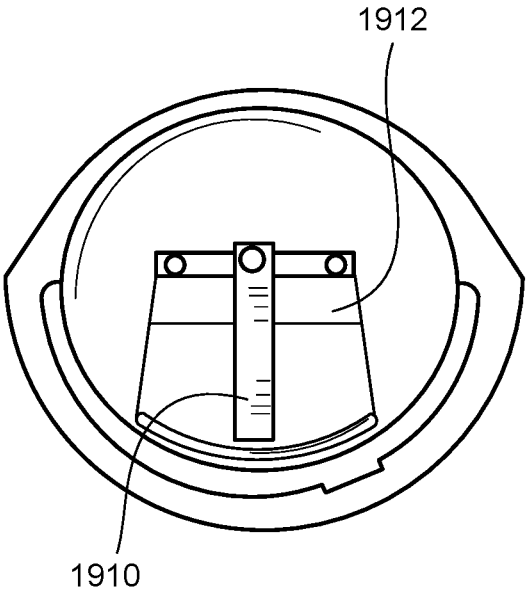
FIG. 19B is a bottom perspective view of another door unit for a debris bin.
Figure 21A:
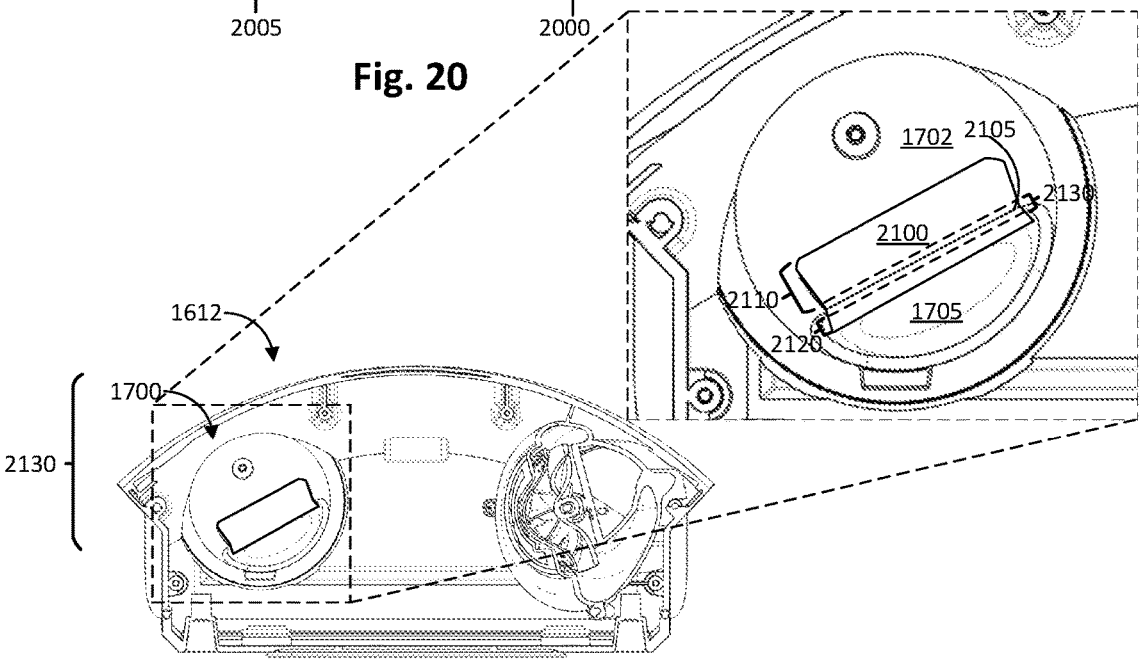
FIG. 21A is a top cross-sectional view of the debris bin of FIG. 17.
Figure 21B:
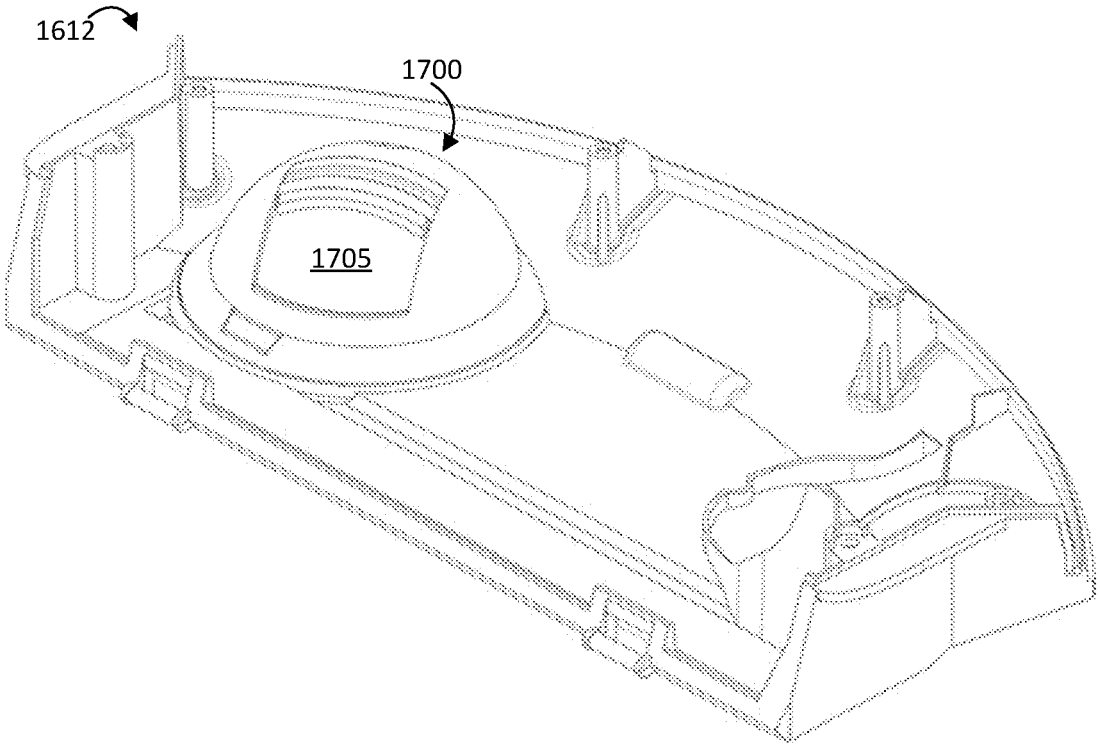
FIG. 21B is a top perspective cross-sectional view of the debris bin of FIG. 17.

In another example, as shown in FIG. 19B, which depicts the underside of the door unit 1700, and FIG. 21B, which depicts a top perspective view of the door unit 1700 within the debris bin 1612, a leaf spring 1910 biases the flap 1705 into the closed position. The flap 1705 rotates about a flexible coupler 1912 that has an approximate rotational axis, and the leaf spring 1910 applies force that generates a torque about the rotational axis that biases the flap into the closed position. The flexible coupler 1912 acts like a hinge which does not have any relative rotation of parts at a mechanical interface, like a mechanical hinge.

Figure 19C:
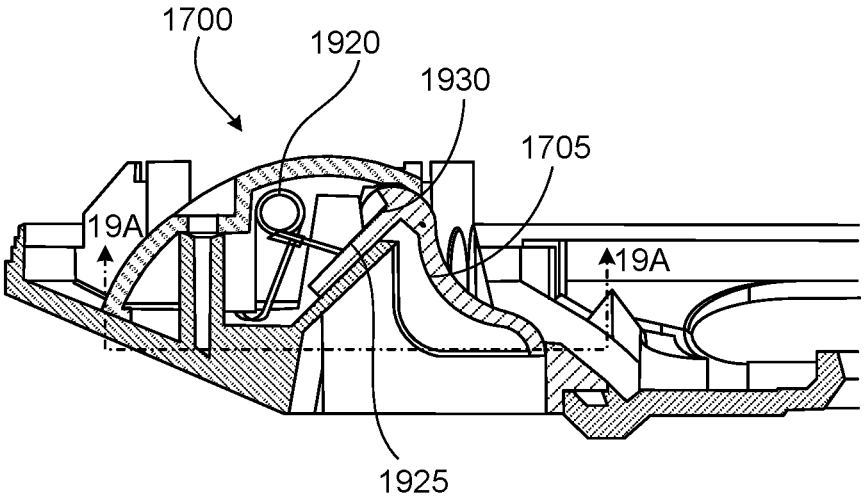
FIGS. 19C and 19D are views of yet another door unit for a debris bin.
Figure 19D:
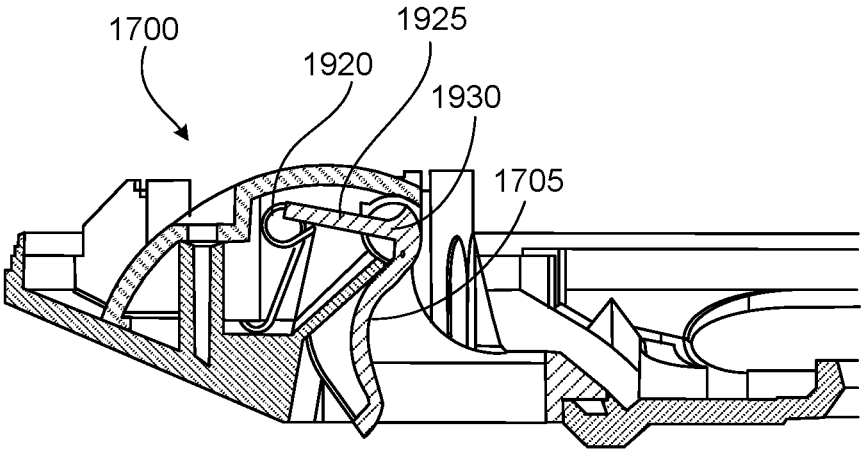

In another example, as shown in FIGS. 19C and 19D which depicts a cross-sectional view of the door unit 1700 and a relaxing spring 1920 of the door unit 1700 that biases the flap 1705 into the closed position. In this example, the spring force that holds the flap 1705 shut relaxes as the flap 1705 opens. Because the spring force relaxes as the flap 1705 opens, the magnitude of the pressure wave that the debris bin sees during evacuation is determined by the cracking pressure on the flap 1705. The amount of material evacuated is affected by how wide the flap 1705 opens. With flow, after the flap 1705 opens, the pressure drops. The relaxing spring 1920 is believed to provide a spring with a high crack force but a low dwell force. The flap 1705 is designed to be closed by a sliding interaction between the spring 1920 and a lever arm 1925 as the flap 1705 opens, the contact point slides up and shortens the lever arm 1925 between the spring 1920 and a flap pivot 1930 and thus reduces the moment on the flap 1705. As a result, a smaller force on the flap 1705 (e.g., from pressure) is required to maintain the flap 1705 open. In some examples, the sliding could be aided by a roller on the flap 1705 along the lever arm 1925 to reduce sliding friction.

During the evacuation operation, the air pressure generated against the flap 1705 causes the flap 1705 to overcome the biasing force exerted by the biasing mechanism (e.g., the torsion spring 1900, the leaf spring 1910, the relaxing spring 1920), thus causing the flap 1705 to move from the closed position (FIG. 17) to the open position (FIG. 18).

During the cleaning operation, the flap 1705 of the door unit 1700 closes the exhaust port 1616 such that the debris 1610 cannot escape through the exhaust port 1616. As a result, the debris 1610 ingested into the debris bin 1612 remains in the chamber 1613. During an evacuation operation as described herein, air pressure causes the flap 1705 of the door unit 1700 to open, thereby exposing the exhaust port 1616 such that the debris 1610 in the chamber 1613 can exit through the exhaust port 1616 into the evacuation station.

Figure 20:
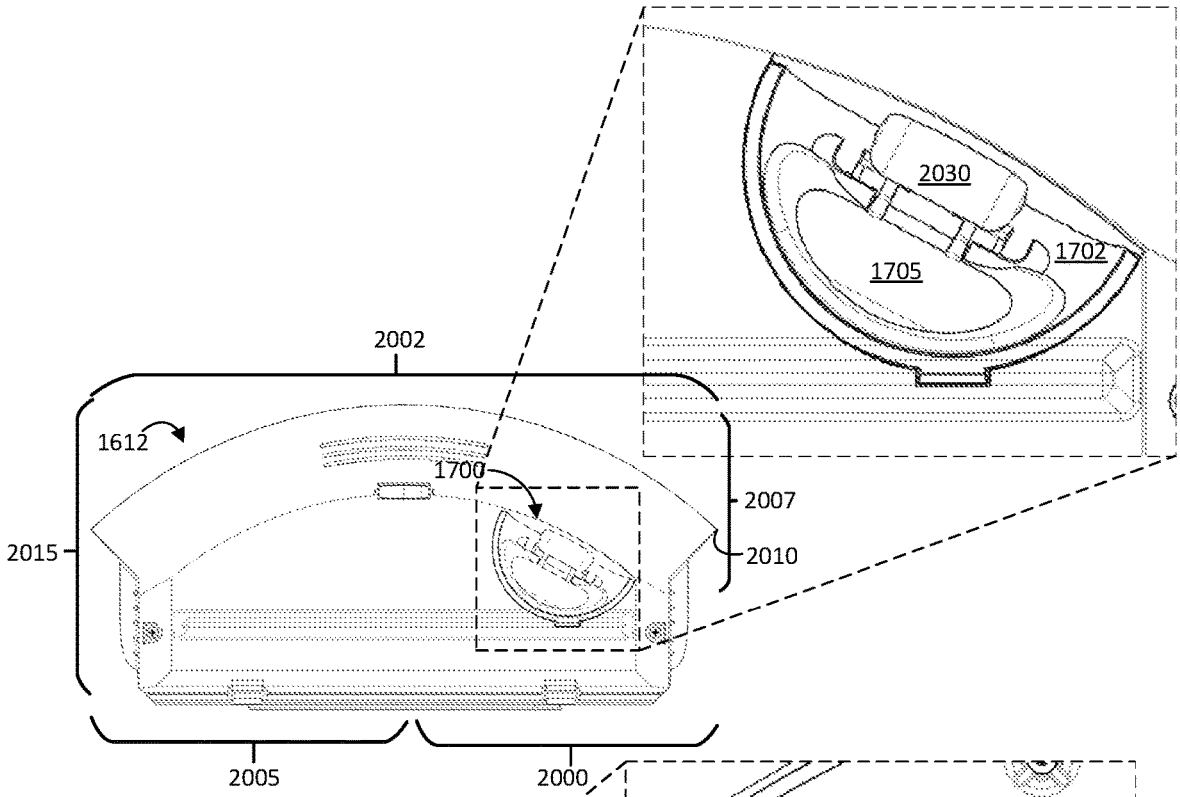
FIG. 20 is a bottom view of the debris bin of FIG. 17.
Figure 22:
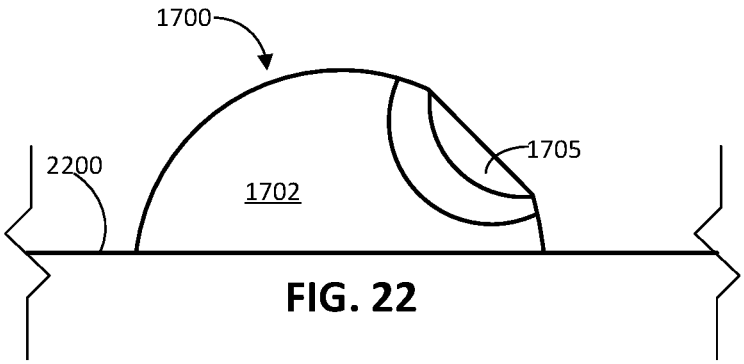
FIG. 22 is a schematic side view of a door unit of the debris bin of FIG. 17.
Figure 23:
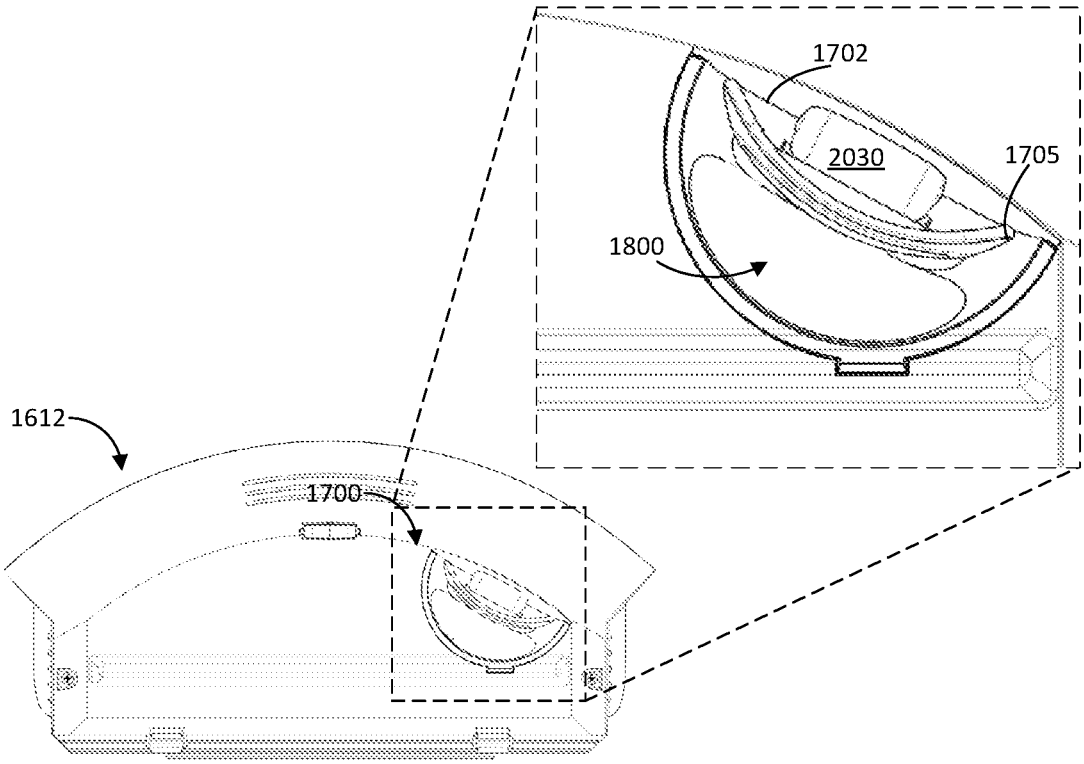
FIG. 23 is a bottom view of the debris bin of FIG. 18.
Figure 24:
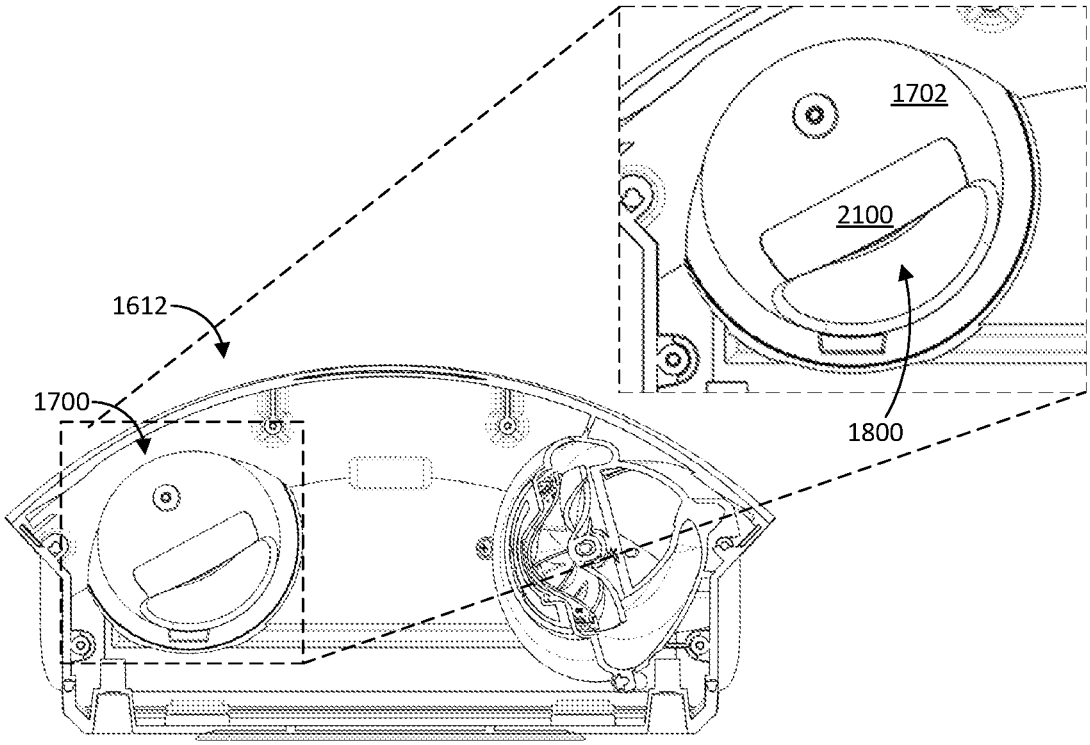
FIG. 24 is a top cross-sectional view of the debris bin of FIG. 18.
Figure 25:
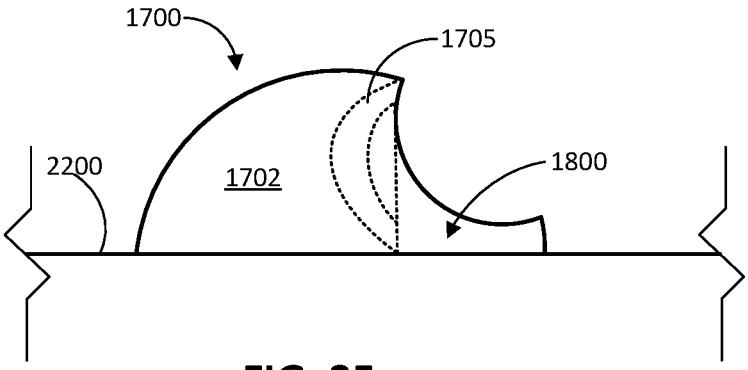
FIG. 25 is a schematic side view of a door unit of the debris bin of FIG. 18.

FIGS. 20 to 22 depict the flap 1705 in the closed position. FIGS. 23, 24, and 25 show the same perspectives of the door unit 1700, as FIGS. 20, 21A, and 22, respectively, but the flap 1705 is in the open position. A biasing mechanism 2030 (e.g., a biasing mechanism that includes the torsion spring 1900 of FIG. 19A, the leaf spring 1910 of FIG. 19B, or the relaxing spring 1920 of FIGS. 19C and 19D), biases the flap 1705 into the closed position (FIGS. 20 to 22). As described herein, the negative air pressure causes the flap 1705 to move into the open position (FIGS. 23 to 25). The flap 1705 in the open position (FIGS. 23 to 25) forms the path 1800, which allows air and thus the debris 1610 to flow through the exhaust port 1616 into the evacuation station.

The flap 1705 in the closed position in FIG. 22 and in the open position in FIG. 25 remain within an exterior surface 2200 (e.g., a bottom surface) of the debris bin 1610. Thus, the flap 1705 cannot inadvertently contact objects outside of the debris bin 1610, such as the floor surface 1603 about which the mobile robot 1600 moves. In some cases, the flap 1705, at a full extension toward the exterior surface 2200 when the flap 1705 is in the open position (FIG. 25), the flap 1705 is above the exterior surface 2200 by a distance between 0 and 10 mm. In some implementations, the flap 1705 may extend past the exterior surface 2200. In such cases, to prevent the flap 1705 from contacting the floor surface (e.g., the surface 1603 of FIG. 16), the flap 1705 can extend a distance less than the clearance distance 1611.

The biasing mechanism 2030 (e.g., which can include the torsion spring 1900, the leaf spring 1910, or the relaxing spring 1920) can have a nonlinear response to the air pressure at the exhaust port 1616. For example, as the flap 1705 moves from the closed position to the open position, the torque generated by the biasing mechanism 2030 can decrease because a lever arm about the axis 1905 for the biasing force of the biasing mechanism 2030 decreases. Thus, the biasing mechanism 2030 can require a first air pressure to move initially from the closed position (FIGS. 20 to 22) to the open position (FIGS. 23 to 25) that is higher than a second air pressure to maintain the door in the open position (FIGS. 23 to 25). The first air pressure can be 0% to 100% greater than the second air pressure, depending on conditions in the environment and the composition of the debris.

The door unit 1700 can be positioned to increase the speed at which debris 1610 can be evacuated from the debris bin 1612. Referring FIG. 20, which shows the flap 1705 in the closed position (e.g., as shown in FIG. 17), the door unit 1700 is located on a half 2000 of a full length 2002 of the debris bin 1612. The door unit 1700 is located opposite to the suctioning mechanism 1606 that occupies a half 2005 of the full length 2002. The door unit 1700 is located adjacent a corner 2010 of the debris bin 1612 such that the door unit 1700 is within a distance of 0% to 25% of the full length 2002 of the debris bin 1612 to the corner 2010. The door unit 1700 can be partially located within a rearward portion 2007 of the debris bin 1612. The flap 1705 faces outwardly towards the debris bin 1612 from the corner 2010 such that debris 1610 from a large portion of the debris bin 1612 is directed toward the path 1800 provided by the flap 1705 in the open position (FIGS. 23 to 25). As a result, when the flap 1705 is in the open position (FIGS. 23 to 25) and the evacuation station has initiated the evacuation operation, the negative air pressure can cause debris 1610 from difficult-to-reach locations throughout the debris bin 1612—including, for example, corners and areas in the rearward portion 2007—to flow into the path 1800 to be evacuated into the evacuation station.

In an example, the full length 2002 of the debris bin 1612 is between 20 and 50 centimeters. The debris bin can have a width 2015 between 10 and 20 centimeters. The door unit 1700 is located between 0 to 8 centimeters from the corner 2010 (e.g., a horizontal distance between 0 and 8 centimeters, a vertical distance between 0 and 8 centimeters). The door unit 1700 can have a diameter between 2 centimeters and 6 centimeters.

As shown in FIGS. 21A, 21B, and 22, the flap 1705 can be made of a solid plastic or other rigid material and can be concavely curved relative to, the support structure 1702. Thus, air pressure within the debris bin 1612 on the flap 1705 during the evacuation operation can result in greater forces on the flap 1705 to cause the flap 1705 to more easily move from the open position (FIGS. 20 to 22) to the closed position (FIGS. 23 to 25).

A stretchable material 2100 can cover part of the flap 1705 such that debris 1610 entering through the path 1800 when the flap 1705 is open (FIGS. 23 to 25) does become lodged between the flap 1705 and the support structure 1702. The stretchable material 2100 can be formed of a resilient material, such as an elastomer. In some implementations, the stretchable material 2100 can be formed of ethylene propylene diene monomer (EPDM) rubber, silicone rubber, polyether block amides, Chloropene rubber, Butyl rubber, among other elastomeric materials. As shown in FIG. 21A, the stretchable material 2100 can cover an intersection 2105 (shown in FIG. 21A) of the flap 1705 and the support structure 1702. Debris 1610 and other foreign material along the intersection 2105 can prevent the flap 1705 from closing and forming a seal with the support structure 1702. Thus, the stretchable material 2100 prevents debris 1610 from gathering at the intersection 2105 so that the debris 1610 does not interfere with proper functionality of the flap 1705 of the door unit 1700. In some implementations, the hinge and stretchable material could be replaced with a flexible coupler (e.g., as described with respect to FIG. 19B) made of similar stretchable materials to perform the same function. In such implementations, the flap 1705 is attached to the support structure 1702 by the flexible coupler.

An adhesive can be used to adhere the stretchable material 2100 to the flap 1705 and to the support structure 1702. The stretchable material 2100 can be adhered to the flap 1705 along a fixed portion 2110 and can be adhered to the support structure 1702 along a fixed portion 2120. The adhesive can be absent at a location 2130 of or above the hinge (e.g., the hinge 1902) about which the flap 1705. The adhesive can further be absent at the intersection 2105 of the flap 1705 and the support structure 1702. Thus, the stretchable material 2100 can flex and deform along the location 2130 while the fixed portions 2110, 2120 of the stretchable material 2100 remain fixed to the flap 1705 and the support structure 1702, respectively, and do not flex. The absence of adhesive along the location 2130 provides a flexible portion for the stretchable material 2100 so that the stretchable material 2100 does not break or fracture due to excessive stress caused by the movement of the flap 1705 from the closed position (FIGS. 20 to 22) to the open position (FIGS. 23 to 25).

During the cleaning operation, the flap 1705 biased into the closed position (FIGS. 20 to 22) due to the biasing mechanism 2030 prevents the debris 1610 from exiting the debris bin 1612 through the exhaust port 1616. During an evacuation operation, the mobile robot 200 docks at the evacuation station so that the evacuation station can generate negative air pressure to evacuate the debris 1610. The debris 1610 can flow through the exhaust port 1616 with air flow generated during the evacuation operation. The flap 1705, forced into the open position (FIGS. 23 to 25) due to the negative air pressure generated during the evacuation operation, provides the path 1800 so that the debris 1610 can travel along a flow path (e.g., flow path 222) to a bag (e.g., bag 235) of the evacuation station. As the debris flow through the exhaust port 1616, the stretchable material 2100 further prevents the debris 1610 from gathering around the biasing mechanism 2030 and at the intersection 2105. Thus, after the evacuation operation, the biasing mechanism 2030 can easily bias the flap 1705 into the closed position (FIGS. 20 to 22), and the mobile robot 200 can continue the cleaning operation and continue ingesting debris 1610 and storing debris 1610 in the debris bin 1612.

The robots described herein can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment.

Operations associated with controlling the robots described herein can be performed by one or more programmable processors executing one or more computer programs to perform the functions described herein. Control over all or part of the robots and evacuation stations described herein can be implemented using special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass PCBs for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. An evacuation station comprising:

an intake port configured to align with an exhaust port of a debris bin of an autonomous mobile robot;

a canister for storing debris drawn from the debris bin of the autonomous mobile robot;

a flow path connecting the intake port to the canister;

an exhaust chamber connected to the canister, the exhaust chamber comprising a plurality of split flow paths extending through the exhaust chamber to an exit port; and a motor configured to generate an airflow carrying the debris from the debris bin, through the flow path, and into the evacuation station, the motor configured to exhaust the airflow through the plurality of split flow paths and through the exit port.

2. The evacuation station of claim 1, wherein the exhaust chamber comprises a motor housing within which the motor is positioned, wherein the motor housing defines an opening through which the airflow is exhausted from the motor into the plurality of split flow paths, and wherein the opening faces away from the exit port.

3. The evacuation station of claim 1, further comprising foam insulation adjacent the plurality of split flow paths.

4. The evacuation station of claim 1, wherein the exhaust chamber comprises a motor housing within which the motor is positioned, and wherein the plurality of split flow paths extend around at least part of the motor housing.

5. The evacuation station of claim 4, wherein a first flow path of the plurality of split flow paths extends adjacent to a first portion of the motor housing, and wherein a second flow path of the plurality of split flow paths extends adjacent to a second portion of the motor housing, the second portion distinct from the first portion.

6. The evacuation station of claim 5, wherein the first flow path extends clockwise from an opening to the exit port around the first portion of the motor housing, and wherein the second flow path extends counter-clockwise from the opening to the exit port around the second portion of the motor housing.

7. The evacuation station of claim 1, wherein the exhaust chamber is positioned below the canister.

8. The evacuation station of claim 1, wherein the motor is configured to draw the airflow through a bag in the canister and, from the bag, into the exhaust chamber.

9. The evacuation station of claim 1, wherein the motor is configured to draw the airflow from below the exhaust chamber, past the exhaust chamber to above the exhaust chamber, and into the exhaust chamber from above the exhaust chamber.

10. The evacuation station of claim 1, wherein the intake port is positioned on a forward portion of the evacuation station.

11. The evacuation station of claim 10, wherein the intake port is positioned along a ramped portion of a base of the evacuation station.

12. The evacuation station of claim 1, wherein the exit port is positioned on a side-facing portion of the evacuation station.

13. The evacuation station of claim 1, further comprising a base comprising:

a ramp to receive the autonomous mobile robot, and a protrusion along the ramp to contact an underside of the autonomous mobile robot.

14. The evacuation station of claim 13, wherein the exit port exhausts the airflow away from the ramp.

15. The evacuation station of claim 1, further comprising first and second wheel ramps extending parallel to a fore-aft axis of the evacuation station, the first and second wheel ramps configured to receive wheels of the autonomous mobile robot.

16. The evacuation station of claim 15, wherein the first and second wheel ramps are proximate to left and right edges, respectively, of the evacuation station.

17. The evacuation station of claim 15, wherein the intake port is positioned proximate to the first wheel ramp or the second wheel ramp.

18. The evacuation station of claim 1, further comprising an electrical contact positioned along a rearward portion of the evacuation station, the electrical contact of the evacuation station being configured to interface with an electrical contact of the autonomous mobile robot to charge the autonomous mobile robot.

19. The evacuation station of claim 18, wherein the canister is positioned along the rearward portion of the evacuation station and over the electrical contact, the electrical contact being positioned opposite the intake port.

20. The evacuation station of claim 18, wherein the electrical contact faces upward, the electrical contact being configured to interface with an electrical contact on an underside of the autonomous mobile robot.

* * * * *